US007689154B2

(12) United States Patent
Asakura et al.

(10) Patent No.: US 7,689,154 B2
(45) Date of Patent: Mar. 30, 2010

(54) IMAGE FORMING APPARATUS HAVING A HEAT FIXING SECTION AND WET FIXING SECTION

(75) Inventors: Kenji Asakura, Kyoto (JP); Shinji Yamana, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 576 days.

(21) Appl. No.: 11/586,008

(22) Filed: Oct. 25, 2006

(65) Prior Publication Data

US 2007/0098422 A1 May 3, 2007

(30) Foreign Application Priority Data

Oct. 25, 2005 (JP) ..... P2005-310264

(51) Int. Cl.
*G03G 15/20* (2006.01)
*G03G 15/16* (2006.01)

(52) U.S. Cl. ..... 399/340; 399/307

(58) Field of Classification Search ..... 399/307, 399/341, 324, 325, 340, 44
See application file for complete search history.

(56) References Cited

U.S. PATENT DOCUMENTS

| | | | | |
|---|---|---|---|---|
| 4,079,228 | A | 3/1978 | Moser | |
| 5,802,440 | A * | 9/1998 | Maeyama | 399/324 |
| 6,091,924 | A * | 7/2000 | Bhattacharya | 399/325 |
| 6,947,700 | B2 | 9/2005 | Kurotori et al. | |
| 7,248,828 | B2 * | 7/2007 | Segerer et al. | 399/341 |
| 7,362,994 | B2 * | 4/2008 | Zess et al. | 399/325 |
| 7,376,378 | B2 * | 5/2008 | Van Bortel | 399/325 |
| 2001/0043825 | A1 * | 11/2001 | Kim | 399/307 |
| 2002/0044805 | A1 * | 4/2002 | Hasegawa | 399/325 |
| 2003/0044203 | A1 * | 3/2003 | Watanabe | |
| 2004/0101333 | A1 * | 5/2004 | Wu et al. | 399/325 |
| 2004/0105707 | A1 * | 6/2004 | Schlien | 399/325 |
| 2004/0131402 | A1 * | 7/2004 | Kurotori et al. | |
| 2006/0133863 | A1 * | 6/2006 | Asakura et al. | 399/307 |
| 2007/0212128 | A1 * | 9/2007 | Asakura et al. | 399/307 |

FOREIGN PATENT DOCUMENTS

| | | | |
|---|---|---|---|
| JP | 6-348159 | A | 12/1994 |
| JP | 07140704 | A * | 6/1995 |
| JP | 2004-109747 | | 4/2004 |
| JP | 2004-109751 | A | 4/2004 |
| JP | 2004-151626 | | 5/2004 |
| JP | 2004-294847 | | 10/2004 |

* cited by examiner

*Primary Examiner*—Susan S Lee
(74) *Attorney, Agent, or Firm*—Nixon & Vanderhye, PC

(57) ABSTRACT

An image forming apparatus includes a toner image forming section, an image carrying section, a transferring section, a recording material conveying section, a heat fixing section, a wet fixing section, and a recording material supply section. In the image forming apparatus, a surface temperature of fixing roller in the heat fixing section is detected by a temperature sensor and according to a detected result, the recording material conveying section selects either one of the heat fixing section and the wet fixing section as a conveyance destination for a recording material carrying an unfixed toner image.

25 Claims, 10 Drawing Sheets

IMAGE FORMING APPARATUS HAVING A HEAT FIXING SECTION AND WET FIXING SECTION

CROSS-REFERENCE TO RELATED APPLICATION

This application claims priority to Japanese Patent Application No. JP 2005-310264, which was filed on Oct. 25, 2005, the contents of which, are incorporated herein by reference, in their entirety.

BACKGROUND OF THE TECHNOLOGY

1. Field of the Technology

The present technology relates to an image forming apparatus.

2. Description of the Related Art

Image forming apparatuses such as a copying machine, a printing machine, a printer and a facsimile machine generally employs an electrophotographic method, an electrostatic recording method, and the like using toner. For example, in an electrophotographic image forming apparatus is used a photoreceptor drum on a surface of which a photosensitive layer containing a photoconductive substance is formed. In such an image forming apparatus is formed an image as follows: the surface of the photoreceptor drum is uniformly charged by giving electric charges to the surface of photoreceptor drum, an electrostatic latent image corresponding to image information is formed in various image forming processes, the electrostatic latent image is developed by use of toner supplied from a developing section to make a toner image, the resultant toner image is transferred to a recording material such as paper, directly or with assistance of an image carrier, and the toner image on the recording material is subjected to fixing process.

Currently-adopted fixing methods for fixing the unfixed toner image onto the recording material include: a heat fixing method that the unfixed toner image on the image carrier or recording material is heated; and a wet fixing method that fixer fluid having a toner-softening action is applied to a toner image on the image carrier or recording material.

The heat fixing method is such a method that a toner image on the image carrier such as an intermediate transfer belt, or on the recording material is heated into a fused state, and this fused toner image is fixed on the recording material by pressure. For example, an image forming apparatus has been proposed in which a toner image is transferred and fixed onto a recording material in a heated state by heating not only the toner image on the image carrier but also the recording material to which the toner image has not been transferred and fixed (for example, see Japanese Unexamined Patent Publication JP-A 2004-151626).

In this image forming apparatus, fixing force of the toner image onto the recording material is enhanced, but there is a problem that it is not possible to perform a heat fixing operation until a temperature of a heating section rises up to a temperature (which will be hereinafter referred to as "a predetermined temperature" unless particularly mentioned) necessary for fusing the toner, so that a standby time lasting until reach of the predetermined temperature, namely a warm-up time will be required and in particular, when the image forming apparatus is activated, the warm-up time is longer than usual. Further, even when the temperature of the heating section has reached the predetermined temperature, there is still a problem that a large amount of successive image formations results in delay of a heating operation conducted by the heating section, which is to be complied with the image formation, to therefore lead an insufficient heat fixing property of the toner image. The image forming apparatuses of the heat fixing method have the above-mentioned problems in common.

On the other hand, in the wet fixing method, fixer fluid having a toner-softening action is applied to the toner image on the image carrier or recording material to thereby soften the toner image so as to fix the softened toner image onto the recording material by pressure. An advantage of the wet fixing method is an extremely small power consumption compared to that in the heat fixing method. For this reason, an image forming apparatus of combined wet fixing method and heat fixing method has been proposed.

For example, there has been proposed a fixing apparatus in which a coating roller carrying on a surface thereof fixer fluid comes into contact with a toner image carried on an image carrier or recording material so that the fixer fluid is applied selectively to only a toner attached portion of the toner image, and the toner and the fixer fluid are heated (for example, see Japanese Unexamined Patent Publications JP-A 2004-109747). That is to say, this fixing apparatus employs a method in which heating is conducted by a heating section after the fixer fluid is applied to the toner image on the image carrier or recording material. By thus heating the toner image to which the fixer fluid has been applied, softening of the toner is promoted so that a transferring-fixing property of the toner image onto the recording material is enhanced. Furthermore, evaporation of excess liquid contained in the fixer fluid is promoted, so that an amount of the fixer fluid attached to the recording material is minimized, with the result that there exists an advantage that wrinkles, curls and the like defects are prevented from being generated in the recording material.

Further, JP-A 2004-109747 discloses the following constitution. That is, in a case where the toner image is carried on the image carrier, an intermediate transfer belt serving as the image carrier is treated with water-shedding processes such as fluorine treatment. Accordingly, in a case where the fixer fluid is applied to an unfixed toner image on the intermediate transfer belt, the fixer fluid gathers only on a toner portion (an image portion) while the fixer fluid does not stagnate on a portion where the toner does not exist (a non-image portion).

However, in the image forming apparatus described in JP-A 2004-109747, the fixer fluid is used indispensably for softening the toner image and as a result, a usage of the fixer fluid is large. This poses a problem that it is necessary to replenish a large amount of the fixer fluid frequently. This is especially prominent in a high-speed machine which outputs a large number of sheets per hour. The frequent replenishment of the fixer fluid also leads deterioration of high-speed property in forming images, which is originally an advantage of the high-speed machine. Although it is conceivable to enlarge a tank for storing the fixer fluid so as to eliminate necessity of the frequent replenishment of the fixer fluid, this leads to an increase in size of the image forming apparatus itself and is thus not preferable. Further, in the image forming apparatus of JP-A 2004-109747, the evaporation of the excess liquid is promoted by the heating section, with the result that a problem originally posed in the heat fixing method such that the warm-up time is necessary, has not been solved. If the image forming operation is performed in a state where a temperature of the heating section has yet been reached the predetermined temperature, the fixer fluid is pressed at a nip portion (contact portion) between the image carrier and the coating roller so that meniscus is formed at an entrance of the nip portion where the fixer fluid therefore stagnates, and the excess fixer fluid is attached to the coating roller again and made to be pushed back, in a consequence whereof there is a stream of the fixer fluid generated at the entrance of the nip portion. In addition, a mutually-binding force of toner particles constituting the toner image is weak and therefore, a part of the toner may be swept away. This may cause troubles such as irregularities of the toner image and thus irregularities of the image and fixing failure.

SUMMARY OF THE TECHNOLOGY

An object the technology is to provide an image forming apparatus which performs both of a heat fixing operation and a wet fixing operation, the image forming apparatus in which a usage of fixer fluid is reduced so as to decrease a frequency of replenishing the fixer fluid, and which generates no irregularities of a toner image, fixing failure, and the like troubles attributable to a flow of excess fixer fluid and further shortens a warm-up time necessary for the heat fixing operation.

The technology provides an image forming apparatus comprising:

a toner image forming section that forms a toner image composed of toner;

an image carrying section that carries an unfixed toner image;

a transferring section that transfers the unfixed toner image on the image carrying section onto a recording material;

a heat fixing section including a heating section that heats and fuses the unfixed toner image, and a fixing member that fixes onto the recording material the unfixed toner image being heated and fused;

a wet fixing section that applies to the unfixed toner image fixer fluid having an action of softening the toner; and a temperature detecting section that detects a temperature of the fixing member.

There is provided an image forming apparatus including a toner image forming section, an image carrying section, a transferring section, a heat fixing section, a wet fixing section, and a temperature detecting section. The image forming apparatus includes two toner image fixing sections, i.e., the heat fixing section and the set fixing section, as well as the temperature detecting section for detecting a temperature of the fixing member which is a part of the heat fixing section.

In other words, in the image forming apparatus, in a case where the temperature of the heating section is lower than a temperature (for example, 180° C.) necessary for fusing and fixing a toner image, a wet fixing operation is conducted by the wet fixing section. In a case where the temperature of the heating section is equal to or more than the temperature necessary for fusing and fixing the toner image, a heat fixing operation is conducted by the heat fixing section. Accordingly, without a need to wait until a warm-up time of the heating section has passed, it is possible to conduct the fixing operation of the toner image. Further, even in a case where a large amount of images are continuously outputted and therefore a heat fixing property is insufficient, continuous outputs can be achieved by shifting the operation to the wet fixing operation, with the result that throughput of a recording paper can be prevented from decreasing. Moreover, in a case where the temperature of the heating section is sufficiently high, it is possible to conduct the fixing operation through the heat fixing section, with the result that a usage of the fixer fluid can be reduced. This eliminates a need to replenish the fixer fluid frequently. As a consequence, it is possible to downsize a fixer fluid storage tank and further the image forming apparatus itself.

Further, there can be employed a constitution such that before the toner image is transferred onto the recording material, the toner image on the image carrying section is subjected to heat or application of the fixer fluid so that toner particles are softened and swelled, with the result that there are increased mutually-binding force of the toner particles and adherability between the toner particles and the recording material. In this constitution, it is possible to prevent the toner from spattering and being attached to the recording material before a portion (a transferring nip portion) where the recording material and the image carrying section are close to each other and where the toner image is transferred and fixed onto the recording material, and thus prevent the toner image which is to be transferred onto the recording material, from having spatters of the toner generated partly thereon. As a result, it is possible to obtain an image of high quality and high resolution.

Further, by employing a constitution such that the image carrying section is formed of a material which is not impregnated with the fixer fluid and that the fixer fluid is applied to the unfixed toner image on the image carrying section, it is possible to largely reduce an application amount of the fixer fluid necessary for fixing the toner image.

Further, it is preferable that the wet fixing section applies the fixer fluid to the unfixed toner image by way of the fixing member.

By employing a constitution such that the fixer fluid is applied from the wet fixing section to the fixing member and then applied from the fixing member to the toner image, it is possible to further prevent the toner image from having irregularities attributable to the fixer fluid when the fixer fluid is applied to the toner image.

Further, it is preferable that the image forming apparatus further comprises a recording material conveying section which conveys the recording material for carrying the unfixed toner image, to the heat fixing section or the wet fixing section.

Further, it is preferable that the image forming apparatus further comprises a recording material conveying section which conveys the recording material for carrying the unfixed toner image, to the heat fixing section by way of the wet fixing section.

The image forming apparatus further comprises a recording material conveying section for conveying the recording material which carries the unfixed toner image, to the heat fixing section or the wet fixing section, or alternatively to the heat fixing section by way of the wet fixing section. By so doing, a conveyance path of the recording material is set depending on a fixing method. Accordingly, even when troubles such as jams are caused in the heat fixing section, for example, a fixing operation of the toner image can be continuously performed in the wet fixing section. Particularly, in a case of employing the constitution that the recording material is conveyed to the heat fixing section by way of the wet fixing section, the number of the conveyance path of the recording material is one and therefore, it becomes further easier to change a usage of the fixer fluid sequentially according to an increase in the temperature of the toner image and to shift the fixing method while appropriately using the heat fixing section and the wet fixing section in combination. Furthermore, since the number of the conveyance path is one, it is not necessary to provide plural sets of discharge process members (such as discharge rollers, discharge trays, and discharge ports), resulting in advantages especially in terms of miniaturization, simplification, and cost-reduction of the image forming apparatus.

Further, it is preferable that the recording material conveying section comprises a conveyance switching section which switches a conveyance destination of the recording material for carrying the unfixed toner image, according to a result of temperature detected by the temperature detecting section.

The recording material conveying section comprises a conveyance switching section for switching a conveyance destination of the recording material which carries the unfixed toner image, according to a result of temperature detected by the temperature detecting section. By so doing, it is possible to switch the conveyance destination more smoothly in accordance with the temperature of the fixing member from the heat fixing section to the wet fixing section or the other way around.

Further, it is preferable that the wet fixing section comprises:

an applying member which applies the fixer fluid; and a fixer fluid storage section which stores the fixer fluid and supplies the fixer fluid to the applying member.

By using the wet fixing section including an applying member for applying the fixer fluid and a fixer fluid storage section for storing the fixer fluid and supplying the fixer fluid to the applying member, it becomes easier to control the application amount of the fixer fluid, and a structure of the wet fixing section can be simplified and reduced in size.

Further, it is preferable that the applying member adjusts an application amount of the fixer fluid according to the result of temperature detected by the temperature detecting section.

By employing a constitution such that the applying member adjusts the amount of the fixer fluid applied to the unfixed toner image according to the result of temperature detected by the temperature detecting section, it is possible to precisely control the application amount of the fixer fluid according to the temperature of the fixing member, so that the application amount of the fixer fluid can be made to fall in an appropriate range. As a result, there can be no excessive use of the fixer fluid any more, and moreover it is possible to obtain at any time an image on which the toner image is solidly fixed. The adjustment of the application amount of the fixer fluid includes, to be specific, reducing the application amount of the fixer fluid as the temperature of the fixing member approaches a predetermined temperature, and inversely, increasing the application amount of the fixer fluid as the temperature of the fixing member becomes lower than the predetermined temperature, and stopping to apply the fixer fluid or applying a slight amount of the fixer fluid when the temperature of the heating section becomes equal to or higher than the predetermined temperature.

Further, it is preferable that the wet fixing section further includes an attaching/detaching section which supports the applying member detachably with respect to the image carrying section or the fixing member, the attaching/detaching section bringing the applying member into contact with the image carrying section or the fixing member according to the result of temperature detected by the temperature detecting section, and wherein the applying member applies the fixer fluid in a state of being in contact with the image carrying section or the fixing member.

By employing a constitution such that the wet fixing section includes an attaching/detaching section which supports the applying member detachably with respect to the image carrying section or the fixing member (hereinafter referred to collectively as "an image carrying section etc." unless particularly mentioned) and which brings the applying member into contact with the image carrying section etc., according to the result of detected temperature, and the applying member applies the fixer fluid in a state of being in contact with the image carrying section etc., it is possible to carry out the application of the fixer fluid to the unfixed toner image smoothly and stably through the applying member. To be specific, for example, there is employed a constitution that in a case where the temperature of the toner image has not reached a predetermined temperature which is minimum required for fusing and fixing of the toner, the applying member comes into contact with the image carrying section etc., and in a case where the temperature of the toner image has reached the predetermined temperature and as appropriate is further rising, the applying member is moved away from the image carrying section etc. In this constitution, the applying member comes into contact with the image carrying section etc., only when the fixer fluid is being applied and therefore, as compared to a case where the applying member is constantly in contact with the image carrying section etc., the usage of the fixer fluid can be minimized so that a consumed amount of the fixer fluid can be reduced. Further, the applying member comes into contact with the image carrying section etc., only when the temperature of the toner image and thus the temperature of the image carrying section etc., are lower than the predetermined temperature. Accordingly, a range of temperature rise of the applying member is small. This makes it possible to suppress changes in components caused by evaporation of a component or a solvent having an action of softening the toner contained in the fixer fluid so that the fixer fluid is prevented from being altered in quality. As a result, it is possible to obtain a stable fixing action so that images of high quality can be stably formed. Moreover, the applying member according to a contact application method can be configured so as to carry the fixer fluid on a surface thereof and move the fixer fluid to the toner image by coming into contact with the toner image. Accordingly, it is not necessary to provide a nozzle which easily causes a liquid blockage, so that miniaturization, simplification of the configuration, and cost-reduction can be easily attained. Note that in a case of increasing further the temperature of the toner image over the predetermined temperature which is minimum required, the applying member which leads decrease in temperature is not in contact with the toner image, resulting in an advantage that it takes a shorter time to rise the temperature of the toner image.

Further, it is preferable that the applying member includes a fixer fluid atomization section disposed away from the image carrying section or the fixing member, wherein the fixer fluid atomization section forms the fixer fluid into droplets and sprays the droplets to the image carrying section or the fixing member.

By using as the applying member a fixer fluid atomization section disposed away from the image carrying section etc., for forming the fixer fluid into droplets and spraying the droplets to the image carrying section etc., it is possible to apply the fixer fluid without generating irregularities in the toner image even when the temperature of the image carrying section etc. is as low as a room temperature, for example, with low adherability between the toner particles and the image carrying member etc. Accordingly, it is not necessary to wait until the temperature of the image carrying section etc. rises up to a certain level.

Further, it is preferable that a droplet diameter of the fixer fluid formed by the fixer fluid atomization section is equal to or less than twice an average particle diameter of toner.

By setting a droplet diameter of the fixer fluid formed by the fixer fluid atomization section to be equal to or less than twice an average particle diameter of a toner particle, it is possible to prevent the toner image from suffering irregularities due to agglomeration of the toner particles when the droplet of the fixer fluid is attached to the toner image, so that uniform images of high quality can be stably formed. When the droplet diameter is more than twice the average particle diameter of the toner particle in a state where the adherability between the toner particle and the image carrying member is low, the droplets make the toner particles near by agglomerate when being attached to the toner image. By so doing, there are generated irregularities in the toner image which are minute but can be recognized by naked eyes.

Further, the technology provides an image forming apparatus comprising:

a toner image forming section that forms a toner image composed of toner;

an image carrying section that carries an unfixed toner image;

a transfuse section that transfers and fixes the unfixed toner image on the image carrying section onto a recording material;

a heating section that heats and fuses the unfixed toner image on the image carrying section;

a wet fixing section including an applying member that applies to the unfixed toner image on the image carrying section fixer fluid having an action of softening toner, and an attaching/detaching section that supports the applying member detachably with respect to the image carrying section; and a temperature detecting section that detects a temperature of the image carrying section.

Further, the technology provides an image forming apparatus comprising:

a toner image forming section that forms a toner image composed of toner;

an image carrying section that carries an unfixed toner image;

a transfuse section including a transfuse member that transfer and fixes the unfixed toner image on the image carrying section onto a recording material;

a heating section that heats and fuses the unfixed toner image on the transfuse member;

a wet fixing section including an applying member that applies to the unfixed toner image on the transfuse member fixer fluid having an action of softening toner, and an attaching/detaching section that supports the applying member detachably with respect to the transfuse member; and a temperature detecting section that detects a temperature of the transfuse member.

There is provided an image forming apparatus comprising: a toner image forming section; an image carrying section; a transfuse section for transferring and fixing the unfixed toner image on the image carrying section onto a recording material or a transfuse section including a transfuse member for transferring and fixing the unfixed toner image on the image carrying section onto the recording material; a heating section for heating and fusing the unfixed toner image on the image carrying section or transfuse member; a wet fixing section including an applying member for applying fixer fluid to the unfixed toner image on the image carrying section or transfuse member, and an attaching/detaching section for supporting the applying member detachably with respect to the image carrying section or transfuse member; and a temperature detecting section for detecting a temperature of the image carrying section or transfuse member.

In the image forming apparatus, as in the case of the above-described image forming apparatus, in a case where the temperature of the heating section is lower than a temperature (for example, 180° C.) necessary for fusing and fixing a toner image, a wet fixing operation is conducted by the wet fixing section. In a case where the temperature of the image carrying section or transfuse member is equal to or more than the temperature necessary for fusing and fixing the toner image, a heat fixing operation is conducted. Accordingly, without a need to wait until a warm-up time of the heating section has passed, it is possible to conduct the fixing operation of the toner image. Even when images are continuously formed and therefore a heated and fused level of the toner image through the heating section is insufficient, continuous outputs can be achieved by shifting the operation to the wet fixing operation or by using the wet fixing operation in combination, with the result that throughput of a recording paper can be prevented from decreasing. Moreover, in a case where the heating temperature of the heating section is sufficiently high, it is not necessary to apply the fixer fluid, with the result that a usage of the fixer fluid can be reduced.

Further, it is preferable that the wet fixing section further includes a fixer fluid storage section which stores the fixer fluid and supplies the fixer fluid to the applying member.

By using the wet fixing section including a fixer fluid storage section for storing the fixer fluid and supplying the fixer fluid to the applying member, it becomes easier to control the application amount of the fixer fluid, and a structure of the wet fixing section can be simplified and reduced in size.

Further, it is preferable that the wet fixing section further includes a passage detecting section which detects that the unfixed toner image on the image carrying section or transfuse member has passed through a contact portion between the image carrying section or transfuse member and the applying member, wherein the attaching/detaching section moves the applying member away from the image carrying section or transfuse member according to a result detected by the passage detecting section that the unfixed toner image has passed through the contact portion.

By employing a constitution such that the wet fixing section includes a passage detecting section for detecting that the unfixed toner image on the image carrying section or transfuse member has passed through a contact portion between the image carrying section or transfuse member and the applying member, and according to a result detected by the passage detecting section, the attaching/detaching section moves the applying member away from the image carrying section or transfuse member, excess fixer fluid is never applied onto the image carrying section or transfuse member after the toner image has passed through the contact portion for application of the fixer fluid, so that the consumed amount of the fixer fluid can be reduced furthermore. Furthermore, the temperature of the applying member can be prevented further from rising, and the fixer fluid can be also prevented further from undergoing quality alternation which is caused in accompaniment with the rise in temperature of the applying member. Accordingly, the quality of the images can be made higher.

Further, it is preferable that the wet fixing section further comprises:

an applying member driving section that rotates the applying member about a shaft center thereof; and a contact detecting section that detects a contact state between the applying member and the image carrying section or transfuse member, wherein the applying member driving section rotates the applying member according to a result detected by the contact detecting section, when the applying member comes into contact with the image carrying section or transfuse member, or when the applying member moves away from the image carrying section or transfuse member.

The wet fixing section includes an applying member driving section for rotating the applying member, and a contact detecting section for detecting a contact state between the applying member and the image carrying section or transfuse member. By employing a constitution such that according to the result detected by the contact detecting section, the applying member is rotated when being in contact with the image carrying section or transfuse member, or when moving away from the image carrying section or transfuse member in contact with the applying member, it is possible to prevent image defects such as jitter and uneven density from being generated, even when a rotational velocity of the image carrying section or transfuse member fluctuates by a load change generated when the applying member comes into contact with the image carrying section or transfuse member and when the applying member moves away from the image carrying section or transfuse member.

Further, it is preferable that the wet fixing section further comprises:

a storing section that stores a result of temperature detected by the temperature detecting section, a boiling point of a solvent contained in the fixer fluid, a softening point of the toner, and a glass transition temperature of the toner; and a calculating section that compares a result of previously-detected temperature with a result of subsequently-detected temperature, both of which are stored in the storing section, to determine whether the detected temperature is increasing or decreasing, or comparing the detected temperature with at least one of the boiling point of the solvent contained in the fixer fluid, the softening point of the toner, and the glass transition temperature of the toner, to determine which is higher, wherein the applying member adjusts an amount of the fixer fluid applied to the unfixed toner image according to a result determined by the calculating section.

By employing a constitution such that the wet fixing section further comprises a storing section for storing a result of temperature detected by the temperature detecting section, and a calculating section for comparing two results of temperatures and so forth to determine which is higher, and the applying member adjusts an application amount of the fixer fluid according to a result determined by the calculating section, it is possible to perform an highly accurate adjustment of the application amount of the fixer fluid according to a change in temperature of the toner image. As a result, an excess usage of the fixer fluid is reduced furthermore so that an image forming operation can be stabilized. Particularly, even in a case where a large amount of images are continuously formed, it is possible to obtain an image of high quality at any time.

Further, in the invention, it is preferable that the applying member decreases or increases the amount of the fixer fluid applied to the unfixed toner image according to a result obtained by the calculating section that the detected temperature is increasing or decreasing.

By employing a constitution such that two results of temperatures as previously detected and subsequently detected, both of which are stored in the storing section, are compared with each other and when it is determined that the toner temperature is increasing or decreasing, according to the result, the applying member decreases or increases the application amount of the fixer fluid, it is possible to apply an appropriate amount of the fixer fluid to the toner image at any time so that the consumed amount of the fixer fluid can be reduced to the minimum necessary. As a consequence, it is possible to downsize a fixer fluid storage tank and thus downsize the image forming apparatus furthermore. Since the appropriate amount of the fixer fluid is applied at any time, an image quality is no longer deteriorated by an excess amount of the fixer fluid being attached to the toner image to then excessively soften and fuse the toner which is therefore fluidized and of which particles are therefore agglomerated. Accordingly, it is possible to stably obtain images of high quality.

Further, it is preferable that the applying member stops to apply the fixer fluid to the unfixed toner image according to a result that the detected temperature is higher than the boiling point of the solvent contained in the fixer fluid.

By employing a constitution such that the result of detected temperature stored in the storing section is compared with the boiling point of the solvent contained in the fixer fluid by means of the calculating section, and when it is determined that the detected temperature is higher than the boiling point of the solvent, the applying member stops to apply the fixer fluid, it is possible to prevent the fixer fluid from boiling and evaporating, as well as to prevent the fixer fluid from having bubbles generated when boiling, and it is furthermore possible to prevent the toner image from having irregularities attributable to the bubbles generated and thus to prevent the image from being deteriorated. Under a temperature higher than the boiling point of the solvent, the toner image can be easily fixed onto the recording material only by the heat fixing section. Accordingly, the applying operation of the fixer fluid is made to stop to thereby stop using excess fixer fluid, so that the consumed amount of the fixer fluid can be reduced.

Further, it is preferable that the applying member starts to apply the fixer fluid to the unfixed toner image according to a result that the detected temperature is higher than the glass transition temperature of the toner.

The result of detected temperature stored in the storing section is compared with the glass transition temperature of the toner by means of the calculating section and when it is determined that the detected temperature is higher than the glass transition temperature of the toner, it is preferable that the applying member start to apply the fixer fluid to the unfixed toner image. That is to say, when the temperature of the unfixed toner image is higher than the glass transition temperature of the toner, the toner particles are softened so that the adherability between the image carrying section and the toner particles is increased. Accordingly, even when the fixer fluid is applied in contact with the applying member, it is possible to prevent the toner from being transferred onto the applying member, and even when the fixer fluid is applied not in contact with the applying member, it is possible to prevent irregularities from being generated in the toner image when droplets of the fixer fluid fall on the toner image, for example. Further, during an initial operation until the temperature of the image carrying section or transfuse member rises up to the glass transition temperature of the toner, the fixer fluid is applied to the image carrying section or the transfuse member so that the fixer fluid can be prevented from being consumed unnecessarily.

Further, it is preferable that the applying member applies the fixer fluid to the unfixed toner image according to a result that the detected temperature is higher than a temperature intermediate between the glass transition temperature of the toner and the softening point of the toner.

The result of detected temperature stored in the storing section is compared with the glass transition temperature and softening point of the toner by means of the calculating section and when it is determined that the result of detected temperature is higher than a temperature intermediate between the glass transition temperature and the softening point of the toner, it is preferable that the applying member start to apply the fixer fluid to the unfixed toner image. That is to say, by heating the toner particles to a level over the temperature intermediate between the glass transition temperature and the softening point, the toner particles are sufficiently softened so that the adherability between the image carrying section or transfuse member and the toner particles is increased. This makes it possible to more securely prevent the toner from being transferred onto the applying member when the fixer fluid is being applied, and to prevent the irregularities attributable to the droplets of the fixer fluid from being generated in the toner image, for example.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
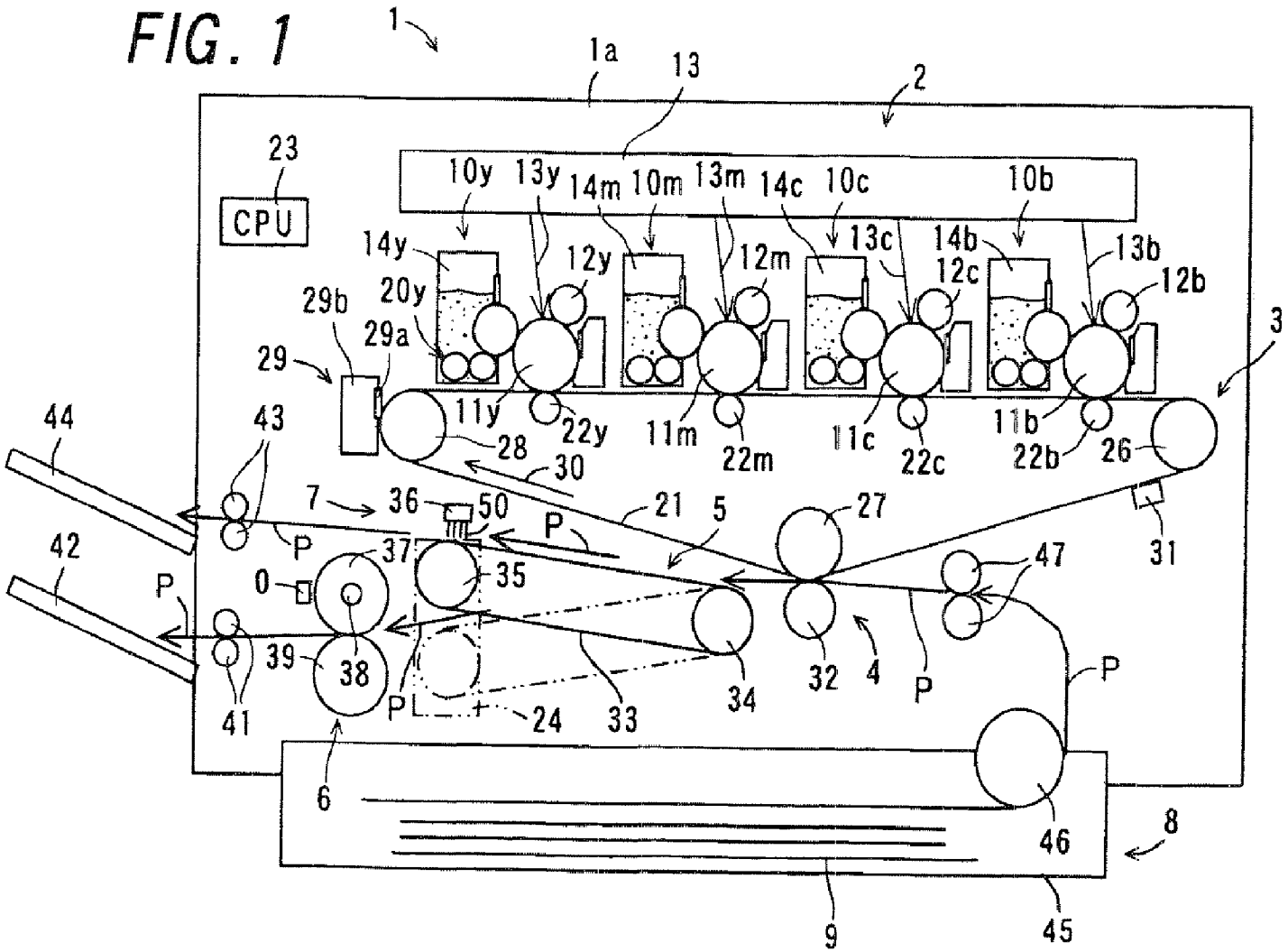
FIG. 1 is a sectional view schematically showing a constitution of an image forming apparatus according to a first embodiment.

Now referring to the drawings, preferred embodiments of the technology are described below.

Figure 2:
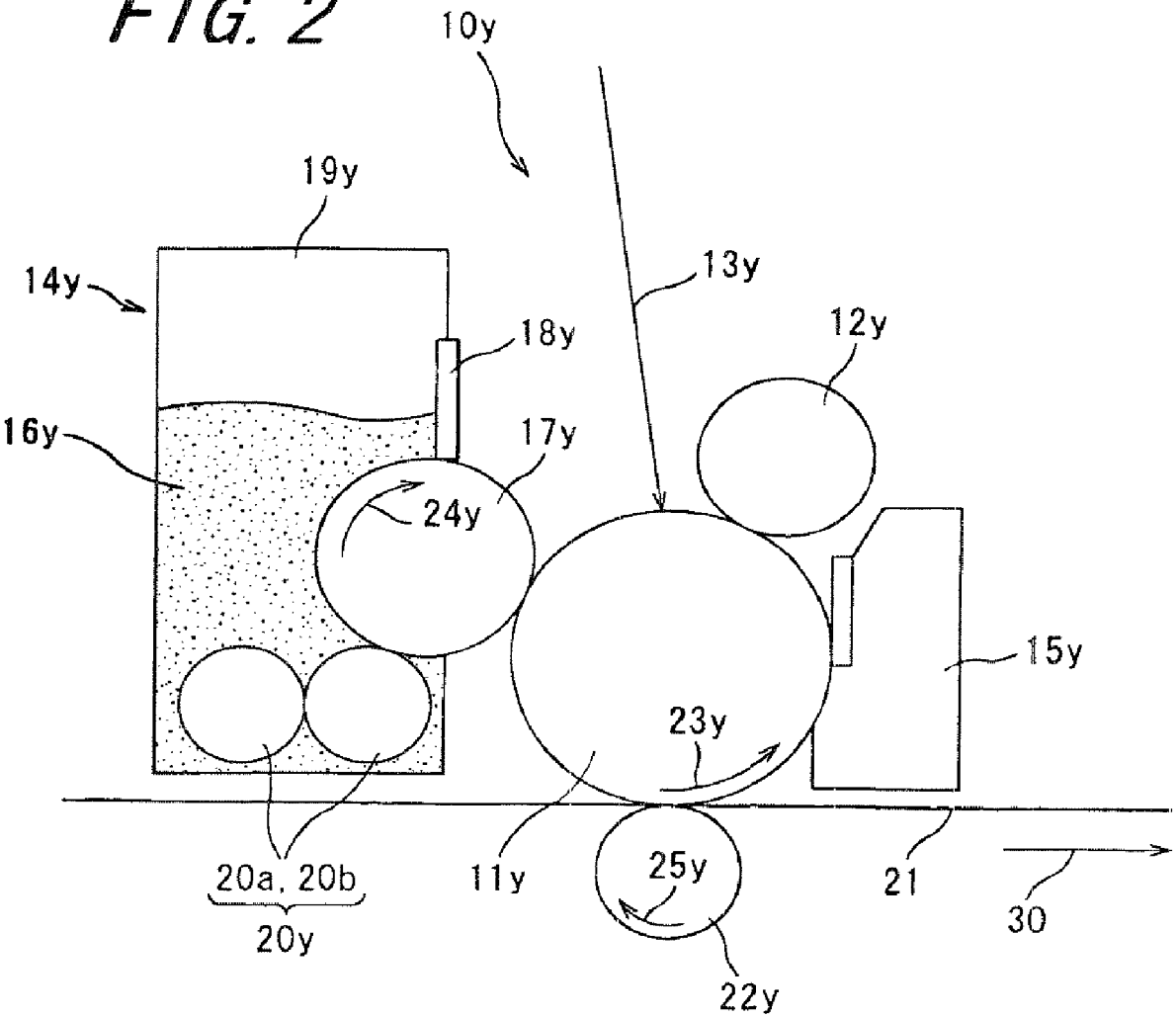
FIG. 2 is an enlarged sectional view showing a principal portion of the image forming apparatus depicted in FIG. 1.

FIG. 1 is a sectional view schematically showing a constitution of an image forming apparatus 1. FIG. 2 is an enlarged sectional view showing a principal portion (a toner image forming section 2 which will be described later) of the image forming apparatus 1 depicted in FIG. 1. Note that the image forming apparatus 1 is a so-called tandem-configured image forming apparatus in which a transferring operation is conducted by sequentially superimposing toner images of four colors, i.e., yellow, magenta, cyan, and black one upon another.

The image forming apparatus 1 includes the toner image forming section 2, an image carrying section 3, a transferring section 4, a recording material conveying section 5, a wet fixing section 7, a heat fixing section 6, and a recording material supply section 8. In the embodiment, in order to define directions, the image forming apparatus 1 is provided so that an upper surface 1*a* thereof is parallel to an installation surface on which the image forming apparatus 1 is placed, that is to say, the upper surface 1*a* is horizontal to the installation surface.

The toner image forming section 2 includes image forming units 10*y*, 10*m*, 10*c*, and 10*b*, which are aligned in a row from an upstream side along a driven direction (sub-scanning direction) of a subsequently-explained intermediate transfer belt 21, namely a direction indicated by an arrow 30. These image forming units 10*y*, 10*m*, 10*c*, and 10*b* form toner images of different colors by developing individual electrostatic latent images formed on the basis of image data corresponding to different color components. More specifically, the image forming unit 10*y* is responsible for formation of a toner image corresponding to yellow image data; the image forming unit 10*m* is responsible for formation of a toner image corresponding to magenta image data; the image forming unit 10*c* is responsible for formation of a toner image corresponding to cyan image data; and the image forming unit 10*b* is responsible for formation of a toner image corresponding to black-color image data.

The image forming unit 10*y* includes a photoreceptor drum 11*y*, a charging roller 12*y*, a light scanning unit 13, a development device 14*y*, and a drum cleaner 15*y*.

The photoreceptor drum 11*y* is a roller member, which is so supported as to be rotatable about its shaft center by a driving section (not shown) and which includes a cylindrical conductive substrate (not shown) connected at a ground potential (GND), and a photosensitive layer formed on the surface of the conductive substrate. For the cylindrical conductive substrate, an aluminum elementary pipe is used, for example. For the photosensitive layer, usable examples include a photosensitive layer formed of zinc oxide, selenium, amorphous silicon, and other substances, and an organic photosensitive layer. The organic photosensitive layers include a layered organic photosensitive layer composed of a charge generating layer and a charge transporting layer laminated one after another; and a single-layer-type organic photosensitive layer composed of one layer containing a charge generating substance and a charge transporting substance. An undercoat layer may be interposed between the conductive substrate and the organic photosensitive layer and further, a protective layer may be provided on a surface of the organic photosensitive layer. In the embodiment is used a 30 mm-diameter photoreceptor drum 11*y* composed of an aluminum elementary pipe and an organic photosensitive layer having a layer thickness of 20 μm formed on the aluminum elementary pipe. Further, in the embodiment, the photoreceptor drum 11*y* rotates in a clockwise direction at a circumferential velocity e.g. of 100 mm/s. Note that the photoreceptor drum 11*y* is not limited to the roller member and may be a column-shaped member, a membrane-sheet-shaped member, and other members.

The charging roller 12*y* is a roller member which applies electric charge over the surface of the photoreceptor drum 11*y* with predetermined polarity and potential. Instead of the charging roller 12*y*, a brush-type charging device, a charger-type charging device, and a corona charging device such as a scorotron charger are also usable. In the embodiment, the charging roller 12*y* charges the photoreceptor drum 11*y* with −600V.

The light scanning unit 13 applies laser light 13*y* acting as signal light corresponding to the yellow image data to the electrically charged surface of the photoreceptor drum 11*y*, thereby forming an electrostatic latent image corresponding to the yellow image data on the surface of the photoreceptor drum 11*y*. As the laser light 13, for example, a semiconductor laser is employed. In the embodiment, an electrostatic latent image is formed at an exposure potential of −70 V.

The development device 14*y* includes a developing roller 17*y*, a developing blade 18*y*, a developer reservoir 19*y* and a pair of agitating rollers 20*y*,20*a*, 20*b*. The developing roller 17*y* which is brought into pressure-contact with the surface of the photoreceptor drum 11*y*, has a stationary magnetic pole (not shown) in its inside, and is rotatable about its shaft center.

The developing roller 17*y* acts to feed the yellow toner 16*y* to the electrostatic latent image formed on the surface of the photoreceptor drum 11*y*. The developing blade 18*y* is disposed so as to abut on the surface of the developing roller 17*y*. The developing blade 18*y* acts to make uniform the toner layer thickness of the yellow toner 16*y* deposited on the surface of the developing roller 17*y*. The toner reservoir 19*y* stores therein the yellow toner 16*y*. The pair of agitating rollers 20*a*, 20*b* are disposed inside the toner reservoir 19*y* in a state of being kept in contact with each other under pressure. The agitating rollers 20*a* and 20*b* are rotatable about their shaft centers to thereby bring a magnetic carrier (not shown) and the yellow toner 16*y* into contact with each other so that the yellow toner 16*y* is charged, whereby the agitating rollers 20*a*, 20*b* act to feed the yellow toner 16*y* to a periphery of the developing roller 17*y*. In the embodiment, the circumferential velocity of the developing roller 17*y* is set at 150 mm/s, which is 1.5 times faster than that of the photoreceptor drum 11*y*. Further, in the embodiment, a d-c voltage of −240 V is applied to the developing roller 17*y*. Further, in the embodiment, a two-component developing agent containing the magnetic carriers is used. However, usable developers are not limited to the two-component developing agent and may include a one-component developing agent made of the yellow toner 16*y* only. The yellow toner 16*y* stored in the toner reservoir 19*y* is mixed with the magnetic carrier by the pair of rotating agitating rollers 20*a*, 20*b*. The yellow toner 16*y* thus charged is fed to the surface of the developing roller 17*y*, and is then made uniform in layer thickness by the developing blade 18*y*. After that, the yellow toner 16*y* is fed to the electrostatic latent image formed on the surface of the photoreceptor drum 11*y* by exploiting a potential difference or other factors at a development nip portion (a portion where the developing roller 17*y* and the photoreceptor drum 11*y* are adjacent to each other), thereby forming a toner image corresponding to the yellow image data.

After the yellow toner image formed on the surface of the photoreceptor drum 11*y* is transferred onto an intermediate transfer belt 21, the drum cleaner 15*y* serves to remove and collect the residual toner remaining on the surface of the photoreceptor drum 11*y*.

Using the image forming unit 10*y*, the surface of the rotating photoreceptor drum 11*y* is charged by the charging roller 12*y* and furthermore irradiated with the laser light 13*y* emitted from the light scanning unit 13, to thereby form an electrostatic latent image to which the yellow toner is then fed from the developing roller 17*y* to conduct a developing operation so that the yellow toner image is formed. The toner image is transferred onto the intermediate transfer belt 21 and after transferred, the toner 16*y* remaining on the surface of the photoreceptor drum 11*y* is removed and collected by the drum cleaner 15*y*. From then on, the above-described process steps for forming the toner image are repeatedly performed in the order.

The image forming units 10*m*, 10*c*, and 10*b* have basically the same structure as the image forming unit 10*y*, with the sole difference being the color of toner for use. That is, the image forming units 10*m* uses a magenta toner 16*m*, the image forming unit 10*c* uses a cyan toner 16*c*, and the image forming unit 10*b* uses a black toner 16*b*. Therefore, the corresponding components will be denoted by the same reference numerals, and yet the reference symbols are suffixed with "m", "c", and "b" that indicate magenta, cyan, and black, respectively, instead of "y", and overlapping descriptions will be omitted.

The yellow toner 16*y*, the magenta toner 16*m*, the cyan toner 16*c*, and the black toner 16*b* being used in the invention contain the same components other than colorants whose types are different from one to another. Hereinafter, these kinds of toner may be collectively referred to as toner 16.

The toner 16 contains a binder resin and a colorant and furthermore, when needed, a release agent.

No particular limitation is imposed on the selection of a binder resin material so long as it is softened and/or swelled satisfactorily by fixer fluid 50 which will be explained later. Specific examples thereof include: polystyrene; a homopolymer of a styrene derivative substitution; a styrene-series copolymer containing one or more substances selected from styrene and a styrene derivative substitution; polyvinyl chloride; polyvinyl acetate; polyethylene; polypropylene; polyester; and polyurethane. As the binder resin, these materials can either be used alone or by way of a mixture of two or more kinds. Among these materials, it is desirable to use a resin material having a softening point in a range of from 100° C. to 150° C., a glass transition temperature in a range of from 50° C. to 80° C., and a Young modulus in a range from 0.5 to 5 GPa in terms of preservability and durability of the toner 16, and control of the softening and/or swelling effect of the toner 16 brought about by application of the fixer fluid 50. It is particularly desirable to use polyester having the same softening point, glass transition temperature and Young modulus. The polyester is easily softened and/or swelled by an easy-to-find organic solvent, and turns out to be transparent. This property of the polyester which turns to be transparent gives sufficient coloration caused by a subtractive color mixing when a plurality of monochromatic toner images of different colors are superimposed one upon another and then fixed as a color toner image onto a recording material 9. Further in a case where the toner image is fixed by the fixer fluid 50, it is possible to use a resin material having a softening point (or a molecular weight) higher than that of the binder resin contained in toner for use in the heat fixing method. The use of such a resin material makes it possible to further prevent the toner 16 from being deteriorated by a load in accompaniment with a development operation, and thereby stably form images of high quality for a longer period of time.

As a colorant, while it is possible to use known pigments or dyes that have conventionally been used to form toner in the field of electrophotographic image formation technology, the use of a pigment material which is insoluble in the fixer fluid 50 is desirable from the standpoint of preventing undesirable toner spreading caused by the fixer fluid 50. Therefore, some dyes like a nigrosin dye are not desirable. Specific examples of the colorant include: organic pigments such as azo-base pigments, benzimidazolone-base pigments, quinacridon-base pigments, phthalocyanine-base pigments, isoindolinone-base pigments, isoindoline-base pigments, dioxazine-base pigments, anthraquinone-base pigments, perylene-base pigments, perynone-base pigments, thioindigo-base pigments, quinophthalone-base pigments, or metal complex-base pigments; inorganic pigments such as carbon black, titanium oxide, molybdenum red, chrome yellow, titanium yellow, chrome oxide, or Berlin blue; and metal powder such as aluminum powder.

No particular limitation is imposed on the selection of a release agent material so long as it is softened and/or swelled satisfactorily by the fixer fluid 50 which will be explained later. Specific examples thereof include wax groups such as a polyethylene wax, a polypropylene wax, and a paraffin wax. Among these types of wax, in accordance with a binder resin being used, it is desirable to use a wax having a glass transition temperature lower than that of the binder resin. The wax having a glass transition temperature lower than that of the binder resin is easily softened when heated and therefore, even under a temperature lower than the softening temperature of the toner 16 itself, there are increased mutually-binding force of the toner 16 and adherability between the toner 16 and the intermediate transfer belt (the image carrier) 21 or recording material 9, etc. Accordingly, this can reduce flowing or coagulating of the toner 16 at the time of the application of the fixer fluid. Another advantage is that, as the wax is softened, the fixer fluid 50 finds its way smoothly into the toner particles from a wax-present part thereof; wherefore the toner 16, in its entirety, can be softened and/or swelled in a short period of time in accompaniment with the application of the fixer fluid 50. As a result, sufficiently high fixation strength can be attained when the toner is transferred and fixed onto the recording material 9 and moreover, an image formed by superimposing toner images of different colors one upon another succeeds in exhibiting good color.

The toner 16 can contain, as appropriate, one or more commonly-used toner additives selected from a charge control agent, a flowability enhancer, a fixation accelerator, a conducting agent, and the like.

Although there is no particular limitation, the volume average particle diameter of the toner 16 is preferably adjusted to fall in a range from 2 to 7 μm. The use of such toner with a small particle size makes it possible to increase the surface area of the toner 16 per unit area, and thereby increase the contact area between the toner 16 and the fixer fluid 50, with the result that the toner fixing process can be facilitated. Hence, not only it is possible to reduce the amount of the fixer fluid 50 to be used, but it is also possible to achieve fixation of a toner image onto the recording material 9 and a post-fixation drying treatment as well in a shorter period of time. Moreover, with a smaller particle diameter of the toner 16, a toner coverage rate with respect to a recording material 9 becomes higher. Accordingly it is possible to produce a high-quality image with a small amount of adherent toner and to reduce a consumed amount of the toner 16. This leads to even further reduction in the amount of the fixer fluid 50 to be used.

When the volume average particle diameter of the toner 16 is less than 2 μm, the flowability of the toner 16 is so low that none of supply, agitation, and charging of the toner 16 can be achieved successfully during a development process. As a result, problems such as shortages of the toner 16 or an undesirable increase of toner having an opposite polarity (reverse-polarity toner) arise, posing the risk of producing an image of poor quality. By way of contrast, when the volume average particle diameter of the toner exceeds 7 μm, there exist a large number of toner particles having a large particle diameter, each of which cannot be softened and/or swelled wholly, with its center part left unchanged. This leads to poor fixability of a toner image with respect to the recording material 9, as well as to an image of poor color. In the case of performing image fixation on an OHP film in particular, quite inconveniently, a transferred image may be gloomy.

The production of the toner 16 can be carried out in conformity with conventionally-known manufacturing methods. For example, the toner 16 can be produced by dispersing a colorant, a release agent, and other necessary agents in a binder resin, followed by pulverization, or produced by dispersing a coloring pigment, a release agent, etc. in a binder resin monomer solution, followed by polymerization of the monomer of the binder resin. In either method, in order to increase the surface area of the toner 16, the toner particles should preferably be adjusted to take on indefinite shape rather than complete spherical shape. This helps facilitate the contact between the toner 16 and the fixer fluid 50, with the result that the amount of the fixer fluid 50 to be used can be reduced and thus toner-image fixation and drying process can be achieved in a short period of time.

In the embodiment, the toners of different colors 16*y*, 16*m*, 16*c*, and 16*b* have the same structural property as described hereinbelow, except for the colorant contained. The toner is designed as an insulative non-magnetic toner to be negatively charged, which contains a binder resin, a colorant, and a release agent and which has a volume average particle diameter of 6 μm, a glass transition temperature of 60° C., a softening point of 120° C. Of the toner as a whole, 12% by weight is a pigment content; 7% by weight is a wax content acting as a release agent; and the remaining content is a binder resin. The binder resin is polyester having a glass transition temperature of 60° C., a softening point of 120° C., and a Young modulus of 2 GPa. The wax is a low-molecular polyethylene wax having a softening point 70° C. In order to obtain a predetermined image density (a reflection density value of 1.4 measured by means of a commercially available reflection densitometer type 310 manufactured by X-Rite) by use of this toner, a required amount of the toner per unit area is 5 g/m$^2$.

The image carrying section 3 includes the intermediate transfer belt 21, intermediate transfer rollers 22*y*, 22*m*, 22*c*, and 22*b* (hereinafter may be collectively referred to as "an intermediate transfer roller 22"), supporting rollers 26, 27, and 28, and a belt cleaner 29.

The intermediate transfer belt 21 is designed as an image (toner image) carrier member in a form of an endless belt stretched across the supporting rollers 26, 27, and 28, for forming a loop-like traveling path. The intermediate transfer belt 21 is driven to rotate in a direction indicated by the arrow 30 at a circumferential velocity which is almost equal to that of the photoreceptor drum 11*y*, 11*m*, 11*c*, 11*b* (hereinafter may be collectively referred to as "a photoreceptor drum 11"). In the embodiment is used the intermediate transfer belt 21 constituted by sequentially forming, on the surface of a 100 μm-thick base made of polyimide, a 300 μm-thick intermediate layer made of silicone rubber and a 20 μm-thick surface coating layer made of fluorine resin composition. In this regard, the fluorine resin composition is obtained by mixing polytetrafluoroethylene (PTFE) and tetrafluoroethylene-perfluoroalkylvinylether copolymer (PFA) at a ratio of 8:2 (by weight). Note that one or more of the base, intermediate layer, and surface coating layer is blended with a conducting agent such as carbon for the purpose of obtaining the electrical resistivity which is necessary for the intermediate transfer belt. Although the intermediate transfer belt 21 constituted as described above is used in the embodiment, no particular limitation is imposed on the selection of the constitution of the intermediate transfer belt 21. For example, the intermediate transfer belt 21 may be a belt-shaped member constituted by forming a surface coating layer made of PTFE, PFA, a compound of PTFE and PFA, and the like material onto a base made of polycarbonate, fluorine rubber or the like material to which conductivity has been applied. Further, the intermediate transfer belt 21 is used in a form of a belt in the embodiment, but no limitation is imposed on the selection of the shape of the intermediate transfer belt 21 and thus, it is also possible to use a drum-shaped image carrier member.

The intermediate transfer roller 22 is a pipe-shaped roller member which is opposed to and brought into pressure-contact with the photoreceptor drum 11 across the intermediate transfer belt 21 and which is rotatably supported about its shaft center by a driving section (not shown). In order for the toner images on the surface of the photoreceptor drum 11 to be transferred onto the intermediate transfer belt 21, an intermediate transfer bias of a polarity reverse to the polarity of the charged toner is impressed on the intermediate transfer roller 22 under constant-voltage control. In this way, the toner images of different color components formed on the surfaces of the photoreceptor drums 11 are superimposedly transferred onto the intermediate transfer belt 21 one after another, thereby forming a multi-color toner image.

For example, the supporting rollers 26, 27, and 28 are each formed of an aluminum-made roll-shaped member which is 30 mm in diameter and 1 mm in wall thickness. A supporting roller 26 is a driving roller which is rotatably supported about its shaft center by a driving section (not shown). The supporting roller 27 stretches the intermediate transfer belt 21 and has also a function in a transferring section 4 which will be explained later. The supporting roller 28 is a tension roller which imparts a tension of predetermined level to the intermediate transfer belt 21. The supporting roller 28 is driven by the rotation of the supporting roller 26, or rotatably supported about its shaft center by a driving section (not shown).

The belt cleaner 29 is disposed so as to face the supporting roller 28 across the intermediate transfer belt 21, and brought into pressure-contact with an image carrying surface 21*a*. The belt cleaner 29 includes a cleaning blade 29*a* and an undesired-substance reservoir 29*b*. The cleaning blade 29*a* is a platy member for scrapping off and thus removing undesired substances such as the residual toner, offset toner, and paper powder remaining on the image carrying surface 21*a* after the toner image has been transferred onto the recording material 9 by the transferring section 4. The undesired-substance reservoir 29*b* temporarily stores therein the undesired-substances scraped off by the cleaning blade 29*a*. The cleaning blade 29*a* may be formed of, for example, a rubber material such as urethane rubber.

In the image carrying section 3, the toner images of different colors formed on the photoreceptor drums 11 are superimposedly transferred at predetermined positions on the image carrying surface 21*a* of the intermediate transfer belt 21. After this multi-color toner image is transferred onto the recording material 9 by the transferring section 4, the undesired substances on the image carrying surface 21*a* are removed by the belt cleaner 29 and then, a new multi-color toner image is transferred onto the image carrying surface 21*a*. The above-described operation is repeatedly performed.

The transferring section 4 includes the supporting roller 27 and a transfer roller 32. The transfer roller 32 is brought into pressure-contact with the supporting roller 27 across the intermediate transfer belt 21 and rotatably supported about its shaft center by a driving section (not shown). The supporting roller 27 serves as a backup roller at the time of transferring the toner image on the intermediate transfer belt 21 onto the recording material 9. For the transfer roller 32, a roll-shaped member including a shaft and an elastic layer formed on a surface of the shaft is used. In the embodiment, there is used a roll-shaped member having an external diameter of 30 mm constituted by sequentially laminating, on the outer surface of a shaft, a 3 mm-thick elastic layer made of silicone rubber which has been hardened to 50 degrees in terms of the hardness in JIS-A and a 20 μm-thick surface layer made of PFA one after another. Further, in the embodiment, the transfer roller 32 is disposed so as to be brought into contact with the supporting roller 27 at a linear pressure of 8 N/cm while no voltage is applied to the transfer roller 32. Hereinafter, a pressure-contact portion between the supporting roller 27 and the transfer roller 32 will be referred to as a transferring nip portion.

Note that a constitution of the transferring section 4 is not limited to the above-described constitution where no voltage is applied to the transfer roller 32. For example, there may be such a constitution that a voltage having a polarity attracting the charged toner forming the toner image is applied to the transfer roller 32 while the supporting roller 27 is made to have a ground potential to thereby form a transference electric field between the transfer roller 32 and the supporting roller 27 so that the toner image on the intermediate transfer belt 21 is electrically transferred onto the recording material 9.

In the transferring section 4, through rotation of the intermediate transfer belt 21, the toner image on the intermediate transfer belt 21 being fed to the transferring nip portion is transferred under a press force onto the recording material 9 which is fed to the transferring nip portion by the subsequently-explained recording material supply section in synchronism with feeding of the toner image toward the transferring nip portion, with the result that the recording material 9 carrying thereon an unfixed toner image can be obtained.

The recording material conveying section 5 includes a conveyance belt 33, a driving roller 34, and a tension roller 35.

The conveyance belt 33 is designed as an endless belt stretched across the driving roller 34 and the tension roller 35, for forming a loop-like conveyance path. The conveyance belt 33 conveys, to the heat fixing section 6 or wet fixing section 7, the recording material 9 on which the toner image has been transferred in the transferring section 4. For example, the conveyance belt 33 may be constituted by forming a 10 μm-thick surface layer made of PTFE on a recording material conveying surfaces of a 100 μm-thick base made of polyimide having electrical conductivity imparted by a conducting agent added thereto. In the embodiment, a contact angle of the fixer fluid 50 with respect to the conveyance belt 33 is set at 70 degrees.

The driving roller 34 is a roller member which is so supported as to be rotatable about its shaft center by a driving section (not shown), for rotating the conveyance belt 33. For example, the driving roller 34 may be composed of a hollow roller made of a metal material such as aluminum.

The tension roller 35 is a roller member which imparts a tension of predetermined level to the conveyance belt 33, and so supported as to be vertically movable and rotatable about its shaft center by a driving section (not shown). A driving section 24 for supporting the tension roller 35 so as to be vertically movable corresponds to a conveyance switching section. Further, the rotation of the tension roller 35 may be either of a driven movement following the rotation of the driving roller 34 and a rotation through another driving section (not shown). For the tension roller 35, there can be used, for example, a roller member including a shaft and a coating layer formed on a surface of the shaft. In the embodiment, the tension roller 35 being used includes a shaft made of stainless steel and a coating layer made of fluorine rubber. When the tension roller 35 is located at a position indicated by solid lines in figures, the recording material 9 carrying the unfixed toner image is conveyed to the wet fixing section 7 by the recording material conveying section 5. When the tension roller 35 is lowered from the position indicated by the solid lines to a position indicated by dashed lines, the recording material 9 carrying the unfixed toner image is conveyed to the heat fixing section 6 by the recording material conveying section 5.

In the recording material conveying section 5, the tension roller 35 is raised or lowered so as to be disposed at a predetermined position to thereby convey the recording material 9 conveying the unfixed toner image to the heat fixing section 6 and the wet fixing section 7.

The heat fixing section 6 includes a fixing roller (fixing member) 37 having therein a heating section 38, a pressurizing roller 39, and a temperature sensor 40 serving as a temperature detecting section.

The fixing roller 37 is a roller member which is so supported as to be rotatable about its shaft center by the driving section (not shown). As the heating section 38 disposed inside the fixing roller 37, for example, a heater formed of a halogen lamp is used. In the embodiment, used as the fixing roller 37 is a roller member composed of a 1 mm-thick shaft made of carbon steel, a 3 mm-thick elastic layer and a 20 μm-thick surface coating layer made of PFA which are formed on an outer surface of the shaft one after another. The elastic layer is made of silicone rubber, the volume resistance of which is adjusted to fall in a range of from $10^8$ to $10^9$ Ω·cm. After all, the roller element is 30 mm in outer diameter. Further, in the embodiment, a surface temperature of the fixing roller 37 is set at 180° C. so that the toner in a fixing nip portion has a temperature higher than its softening point. The toner image on the recording material 9 is brought into contact with the fixing roller 37 by which the toner image is then heated to be softened/swelled to such a level that the toner image is appropriately transferred and fixed onto the recording material 9.

The pressurizing roller 39 is a roller member which is disposed so as to be brought into pressure-contact with the fixing roller 37 and which is driven to rotate about its shaft center by rotation of the fixing roller 37 or rotatably supported by a driving section (not shown). A pressure-contact portion between the fixing roller 37 and the pressuring roller 39 will be referred to as a transferring nip portion. In the embodiment, there is used a roller member constituted by sequentially laminating, on the outer surface of a shaft having an outer diameter of 40 mm, a 2 mm-thick elastic layer made of silicone rubber which has been hardened to 50 degrees in terms of the hardness in JIS-A and a 20 μm-thick surface coating layer made of PFA one after another. Further, in the embodiment, the pressurizing roller 39 is brought into contact with the fixing roller 37 at a linear pressure of 10 N/cm.

The temperature sensor 40 is provided so as to be adjacent to the surface of the fixing roller 37, and used to detect a surface temperature of the fixing roller 37. A result of temperature detected by the temperature sensor 40 is sent to a CPU 23 composed of a storing section, a calculating section, and a control section, for controlling an entire operation of the image forming apparatus 1. In the storing section of the CPU 23 is stored a predetermined temperature required for heat fixing. In the calculating section, the result of currently-detected temperature inputted to the storing section is compared with the predetermined temperature or the like factors, to determine which one of these two values is higher or lower. The control section conducts a control by outputting a control signal in accordance with a result determined by the calculating section.

The control section outputs the control signal to a driving section (not shown) for effecting the vertical movement of the tension roller 35 in accordance with the result that the detected temperature is lower than the predetermined fixing temperature, for example. The tension roller 35 is then moved to the position indicated by the solid lines in figures so that the recording material 9 carrying the unfixed toner image is conveyed to the wet fixing section 7. This applies, to be specific, a situation immediately after start-up or a situation during a recovering operation from a left state of the image forming apparatus 1, a situation of continuous output in a high-speed image forming apparatus whose output number of sheets per minute exceeds 60, and the like situation. Further, in accordance with a result that the detected temperature is higher than the predetermined fixing temperature, the tension roller 35 is moved to the position indicated by the solid lines in figures, and a conveyance destination of the recording material 9 is switched to the heat fixing section 6.

Further, in a case where the heating section 38 can control a calorific value thereof in response to rise and fall in an electric quantity given thereto, the control section outputs a control signal to a power source electrically connected to the heating section 38 in accordance with the determination given by the calculating section to thereby adjust the electric quantity supplied to the heating section 38. That is to say, in a case where the surface temperature of the fixing roller 37 (namely the result of detected temperature) is lower than a temperature (for example, 180° C.) appropriate for heat fixing of the toner 16, the conveyance destination is switched to the wet detecting section 7 and at the same time, a control for increasing the calorific value of the heating section 38 is performed. In a case where the surface temperature of the fixing roller 37 is equal to or more than an appropriate temperature for heat fixing of the toner 16, the conveyance destination is switched to the heat fixing section 6 and when needed, the control section controls the heating section 38 so as to keep its calorific value or so as not to increase its calorific value from the present value.

Further, the heat fixing section 6 detects whether or not the recording material 9 is jammed at the fixing nip portion. The heat fixing section 6 includes a discharge sensor (not shown) electrically connected to the CPU 23. Also when the discharge sensor detects the jammed recording material 9 at the fixing nip portion, the control section of the CPU 23 outputs the control signal to the driving section (not shown) for effecting the vertically movement of the tension roller 35 so that the tension roller 35 is moved to the position indicated by the solid lines in figures to thereby convey the recording material 9 carrying the unfixed toner image to the wet fixing section 7.

By repeating these controls, it is possible to stably keep a state where a throughput is high, continuously after the start-up of the image forming apparatus 1.

In the heat fixing section 6, the recording material 9 carrying the unfixed toner image is heated under pressure at the fixing nip portion so that the toner image is fixed onto the recording material 9. Further, in accordance with the result of temperature detected by the temperature sensor 40, the conveyance destination of the recording material 9 carrying the unfixed toner image, the calorific value of the heating section 38, and the like factors are controlled.

The recording material 9 on which the image has been formed by the heat fixing section 6, is discharged, by way of a pair of discharge rollers 41, to a discharge tray 42 provided on an external side wall of the image forming apparatus 1.

The wet fixing section 7 includes a nozzle head array 36. The nozzle head array 36 gives a droplet of the fixer fluid 50 to only the toner image on the recording material 9 or to an image forming region including the toner image so that the toner 16 constituting the toner image is softened and/or swelled to thereby fix the toner image onto the recording material 9.

As the nozzle head array 36, a component for use in an ink-jet type printer or the like can be used. By use of the nozzle head array 36, it is also possible to apply the fixer fluid 50 selectively to a portion corresponding to the toner image in accordance with an image signal. To the nozzle head array 36 is connected a fixer fluid reservoir (not shown). In accordance with a consumed level of the fixer fluid 50, the fixer fluid 50 is supplied to the nozzle head array 36.

The fixer fluid 50 being used is a liquid preparation for softening and/or swelling the toner 16, for example, an aqueous composition of low viscosity containing water and an auxiliary solvent. The fixer fluid 50 is thus low in viscosity and therefore not permeable into the intermediate transfer belt 21 but smoothly permeable into a toner-to-toner gap of the toner 16, a gap between the recording material 9 and the toner 16, and the like gap so that the auxiliary solvent swells/softens the toner 16 substantially at once. Further, in a case where a heating section such as a heating roller is provided on a portion subjected to the fixer fluid 50, there is also another advantage that it takes a short time for the image to be dried after the toner 16 has been swelled/softened. The auxiliary solvent is an organic compound which can be solved or dispersed in water. Specific examples of the auxiliary solvent include: alcohol groups such as methyl alcohol, ethyl alcohol, propyl alcohol, butyl alcohol, octyl alcohol, decyl alcohol, diethylene glycol, glycerin, polyethylene glycol, phenol, benzyl alcohol, or methyl benzyl alcohol; ketone groups such as acetone, methyl ethyl ketone, methyl butyl ketone, methyl isobutyl ketone, or diethyl ketone; ether groups such as methyl ethyl ether, diethyl ether, methyl butyl ether, methyl isobutyl ether, dimethyl ether, diisopropyl ether, or octyl phenyl ether; and ester groups such as methyl acetate, ethyl acetate, ethyl oleate, ethyl acrylate, methyl methacrylate, dibutyl succinate, diethyl phthalate, diethyl tartrate, ethyl palmitate, or dioctyl phthalate. Among them, the use of an ether group or an ester group is preferable, and an ester group is the most preferable. The auxiliary solvents of these types are excellent in an action for swelling/softening the binder resin, typified by polyester, of the toner 16. As the auxiliary solvent, these materials can either be used alone or by way of a mixture of two or more kinds.

A content of the auxiliary solvent in the fixer fluid 50 is not limited to a particular value, but preferably 5% to 80% by weight or above of the fixer fluid 50 as a whole. More preferably, the content of the auxiliary solvent falls in a range of from 10% to 70% by weight. When the content of the auxiliary solvent is less than 5% by weight, the action for softening/swelling the binder resin in the toner 16 is weak so that sufficiently high fixation strength cannot possibly be attained. On the other hand, when the content of the auxiliary solvent exceeds 80% by weight, the permeability of the auxiliary solvent into the toner image is decreased and particularly in a case where an amount of the toner is large, only a toner on the surface of the toner image is softened/swelled, so that toner inside the toner image is insufficiently fixed onto the recording material 9. This may lead separation of the toner or other troubles.

To the fixer fluid 50 may be added a surfactant, a dispersant, and other agents for the purpose of improving, for example, a wettability of the fixer fluid 50 with respect to the toner 16 and a dispersibility of the auxiliary solvent in the fixer fluid 50. Examples of the surfactant include: salt of higher alcohol sulfuric ester such as lauryl sulfate ester sodium salt; higher fatty acid metal salt such as sodium oleate; a negative ion (anionic) surfactant such as fatty acid derivative sulfuric ester salt or phosphoric ester; a positive ion (cationic) surfactant such as quaternary ammonium salt or heterocyclic amine; an amphoteric ion (nonionic) surfactant such as amino acid ester or amino acid; a nonionic surfactant; polyoxyalkylene alkyl ether; and polyoxy ethylene alkyl amine. Examples of the dispersant include a coupling agent such as diethylene glycol; triethylene glycol; polyethylene glycol; monobutyl ether; or diethylene glycol monomethyl ether.

To the fixer fluid 50 may be added further, according to need, known adhesive ingredients which can be solved or dispersed in the fixer fluid 50. Such ingredients include: a rubber-base adhesive predominantly composed of polymeric elastomer such as chloroprene rubber, nitrile rubber, or SBR rubber; and an emulsion adhesive prepared by dispersing, evenly in water, hydrophilic synthetic resin such as vinyl acetate, EVA, or acrylic resin. With this constitution, not only the toner-softening and/or toner-swelling effect, but also an adhesive power exerted by the adhesive ingredient contributes to the adherability between the toner 16 and the recording material 9. This makes it possible to attain enhanced adherability between the toner 16 and the recording material 9, and thus the toner image can be fixed onto the recording material 9 with sufficiently high fixation strength. A composition of the fixer fluid 50 is not limited to the above-cited components, and other components known as fixer fluid components may be used.

A droplet diameter of the fixer fluid 50 is set to be preferably equal to or less than twice the average particle diameter of the toner particle, and more preferably not larger than the average particle diameter of the toner particle. This makes it possible to prevent the toner image from suffering irregularities due to the flow or agglomeration of a toner generated instantly when the droplet of the fixer fluid 50 is attached to the toner image. Furthermore, by setting the droplet diameter at a small value, there is also another advantage that a traveling direction of the droplets can be changed as appropriate under an electric field force or electric charge. When the droplet diameter is more than twice the average particle diameter of the toner particle, at the instant when the droplet is attached to the toner image, the toner particles nearby are caused to agglomerate. This may lead a generation, in the even toner image, of many irregularities which can be recognized by naked eyes, causing image defects. When a droplet diameter of atomized fixer fluid is larger than the average particle diameter of the toner, the number of coagulative toner particles is so large that the resultant lack of uniformity in the toner image can be discerned visually. In this regard, the correlation between the size of toner particle and the amount of droplets appears to be of a matter of concern. When the amount of droplets is large, toner particles will be swept away. On the other hand, when the size of the toner particle is relatively large, the toner particles will not be swept away. Accordingly, by setting the droplet diameter of the fixer fluid, which is formed by an applying section, to be equal to or less than twice the average particle diameter of the toner, it is possible to prevent the toner particles from being agglomerated when the droplet of the fixer fluid is attached to the toner image. This makes it possible to obtain uniform images of high quality.

Further, in the embodiment, a contact angle of the fixer fluid 50 with respect to the toner 16 is set at 47 degrees.

The recording material 9 on which the toner image has been fixed, is discharged, by way of a pair of discharge rollers 43, to a discharge tray 44 provided on the external side wall of the image forming apparatus 1.

In the wet fixing section 7, the unfixed toner image on the recording material 9 is fixed thereon by application of the fixer fluid 5, and the recording material 9 is then discharged to the discharge tray 44.

The recording material supply section 8 includes a recording material cassette 45, a pickup roller 46, and a pair of registration rollers 47. The recording material cassette 45 stocks the recording materials 9. The pick-up roller 46 directs the recording materials 9 to a conveyance path P one by one. The pair of registration rollers 47 feeds the recording material 9 to the transferring nip portion in synchronism with the conveyance of the toner image carried on the intermediate transfer belt 21 toward the transferring nip portion.

In the recording material supply section 9, the recording materials 9 placed within the recording material cassette 45 are directed to the conveyance path P one by one by means of the pick-up roller 46, and are then fed to the transferring nip portion in synchronism with the conveyance of the toner image toward the transferring nip portion.

On the whole, in the image forming apparatus 1, the toner image formed by the toner image forming section 2 is carried on the intermediate transfer belt 21 contained in the image carrying section 3 and transferred onto the recording material 9 by means of the transferring section 4. And then, the unfixed toner image on the recording material 9 is fixed by the heat fixing section 6 or wet fixing section 7 so that the image is formed.

Figure 3:
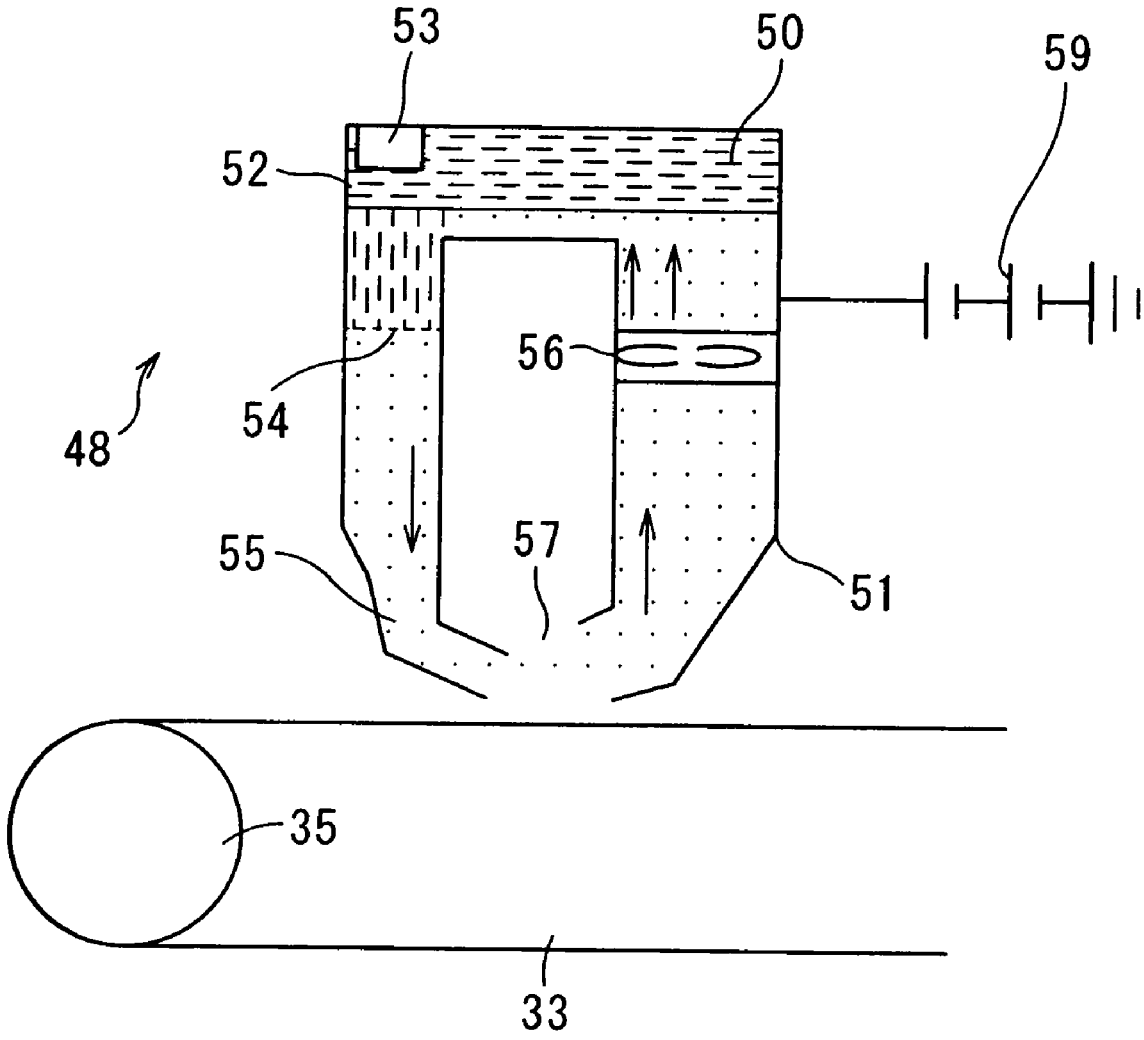
FIG. 3 is a sectional view schematically showing a constitution of a fixer fluid atomization unit.

In the embodiment, the nozzle head array 36 is used in the wet fixing section 7. However, the constitution is not limited to the above constitution and it is thus possible to use, for example, a fixer fluid atomization unit 48 serving as a fixer fluid atomization section as shown in FIG. 3. FIG. 3 is a sectional view schematically showing a constitution of the fixer fluid atomization unit 48.

The fixer fluid atomization unit 48 is a device for forming the fixer fluid 50 into droplets and spraying the droplets to the toner image. The fixer fluid atomization unit 48 includes a main body 51, a fixer fluid storage section 52, an ultrasonic transducer 53, a mesh 54, a spray duct 55, a fan 56, and a power source 59. The main body 51 is made of an electrically conductive material. The fixer fluid storage section 52 is disposed in an upper part of the main body 51, and stores therein the fixer fluid 50. The ultrasonic transducer 53 is disposed so as to make contact with or to be dipped in the fixer fluid 50 stored in the fixer fluid storage section 52. The mesh 54 turns the fixer fluid 50 into fine liquid mist. The spray duct 55 connects a flow inlet to a flow outlet of the main body 51, and includes an opening 57 facing the surface of the conveyance belt 33. The spray duct 55 is used to reflux the misty droplets of the fixer fluid 50 therethrough. The fan 56 produces a current of air on which the misty droplets of the fixer fluid 50 ride in the spray duct 55. The power source 59 applies a voltage to the main body 51. The misty droplets of the fixer fluid 50 are discharged from the opening 57 to outside. Furthermore, a corona charger and a fan may be disposed in the vicinity of the opening 57. This helps facilitate the discharge of the misty droplets through the opening 57.

In the fixer fluid atomization unit 48, a radio-frequency wave (in the embodiment, a high-frequency wave of 2.4 MHz) is applied to the fixer fluid 50 stored in the fixer fluid storage section 52 by means of the ultrasonic transducer 53. A result of oscillation forces the fixer fluid 50 to fly, in the form of droplets of a size of about 3 μm, into the main body 51. Some of the droplets have a diameter as large as 1 mm or above. However, these droplets are directed to the mesh 54 (in the embodiment, a 0.5 mm-pitch stainless steel mesh) by the fan 56. When passing through the mesh 54, the droplets are turned into fine liquid mist. The misty droplets reflux within the spray duct 55 while riding on an air current produced by the fan 56, and eventually come near the opening 57. At this time, the power source 59 is actuated to apply a voltage to the main body 51 so as to cause a potential difference (in the embodiment, a potential difference of +250 V) between the main body 51 and the conveyance belt 33, with the result that the misty droplets are charged to a polarity opposite to that of the charged toner image formed on the recording material 9. In this way, since the misty droplets are charged reversely to the toner image, and also there is a potential difference of +250 V between the opening 57 and the conveyance belt 33, it follows that the misty droplets are loaded with an electric field force that allows them to fly through the opening 57 toward the conveyance belt 33. As a result, the misty droplets are attached to a region including the toner image on the recording material 9 placed on the surface of the conveyance belt 33. At the time, the misty droplets are charged to a polarity opposite to that of the toner and therefore, the misty droplets are attracted to an area where a large amount of the toner exist (the toner image or an image-present portion) in proportion to such a toner amount. This makes it possible to apply the fixer fluid 50 according to the toner amount. In an area other than the toner image (non-image portion) exist a small amount of the toner or no toner, so that an application amount of the fixer fluid 50 is extremely small when compared to that in the image-present portion. As a result, it is made possible to reduce a consumed amount of the fixer fluid 50. Note that the application amount of the fixer fluid 50 to the non-image portion can be controlled by adjusting as appropriate the potential difference between the fixer fluid atomization unit 48 and the conveyance belt 33. Furthermore, this potential difference may be variably set by adjusting as appropriate a thickness, water absorbability, or the other properties of the recording material. In other words, in the fixer fluid atomization unit 48, it is possible to electrically control the application amount of the fixer fluid 50 to the toner image.

In the embodiment, as a section for turning the fixer fluid 50 into the droplets, the ultrasonic transducer 53 is used. However, the section for turning the fixer fluid 50 into the droplets is not limited to the ultrasonic transducer 53, and may be other sections such as a spray device using a high-speed air current. Also in the spray device using a high-speed air current, the application amount of the fixer fluid 50 can be electrically controlled.

Figure 4:
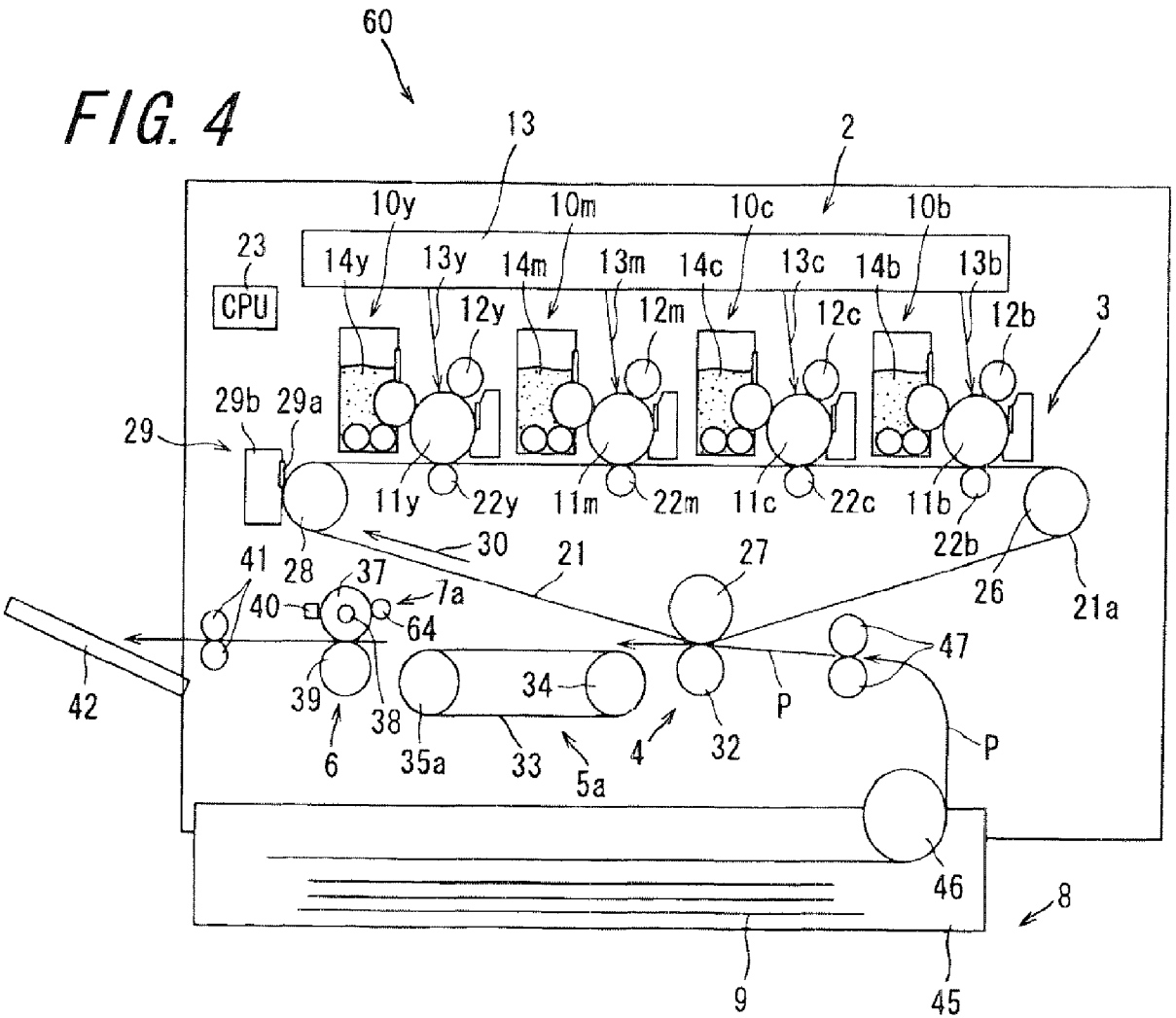
FIG. 4 is a sectional view schematically showing a constitution of an image forming apparatus according to a second embodiment.
Figure 5:
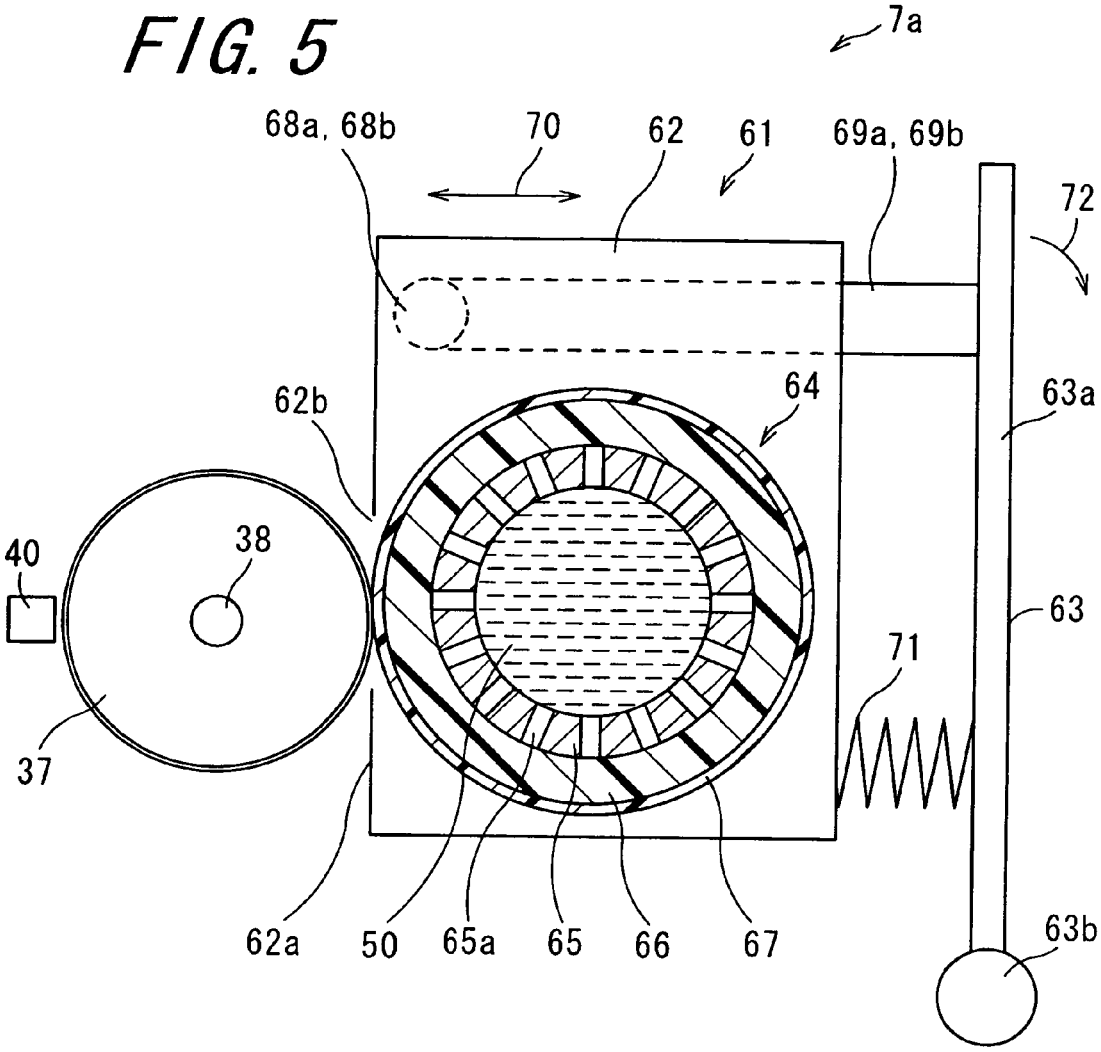
FIG. 5 is an enlarged sectional view showing a principal portion of the image forming apparatus depicted in FIG. 4.

FIG. 4 is a sectional view schematically showing a constitution of an image forming apparatus 60 according to a second embodiment. FIG. 5 is an enlarged sectional view showing a principal portion (a subsequently-explained wet fixing section 7*a*) of the image forming apparatus 60 depicted in FIG. 4. The image forming apparatus 60 is similar to the image forming apparatus 1. Therefore, the components that play the same or corresponding roles as in the image forming apparatus 1 will be denoted by the same reference numerals, and descriptions thereof will be omitted.

In the image forming apparatus 60, as features thereof, the fixer fluid 50 is applied to the surface of the fixing roller 37 by means of an applying roller 64 serving as an applying member, which is detachably provided on the surface of the fixing roller 37. And then, both of the heat fixing operation and the wet fixing operation are simultaneously performed on the unfixed toner image on the recording material 9 which is conveyed to the fixing nip portion by the recording material conveying section 5*a*, with the result that the toner image is fixed on the recording material 9. Further, a recording material conveying section 5*a* contained in the image forming apparatus 60 has a feature that a tension roller 35*a* can only rotate about its shaft center. Accordingly, a conveyance destination of the recording material 9 through the recording material conveying section 5*a* is the heat fixing section 6.

The wet fixing section 7*a* includes a fixer fluid applying member 61.

The fixer fluid applying member 61 includes a casing 62, a support plate 63, and an applying roller 64. The support plate 63 supports the casing 62 so that the casing 62 is detachable and capable of being attached to or detached from the fixing roller 37. The casing 62 and the support plate 63 are formed into a single body by means of a support member (not shown) mounted on the main body of the image forming apparatus 60. The fixer fluid applying member 61 is supported so as to be able to be drawn from an internal space of the image forming apparatus 60 to outside (toward a user, as in the case of the recording material cassette).

The casing 62 accommodates the applying roller 64 which is rotatably supported by the casing 62. In a side 62*a* of the casing 62, facing the fixing roller 37, is formed an opening 62*b* for bringing the applying roller 64 into pressure-contact with the fixing roller 37.

The applying roller 64 is a roller member including a shaft 65, a permeation control layer 66 formed on an outer surface of the shaft 65, and a porous layer 67 formed on an outer surface of the permeation control layer 66. The applying roller 64 is pressed against the fixing roller 37, and a rotary shaft of the applying roller 62 is formed integrally with a flange (not shown) provided on both ends in a longitudinal direction of the shaft 65. The rotary shaft is rotatably supported by a bearing (not shown) provided inside the casing 62. The applying roller 64 is therefore driven to rotate by rotation of the fixing roller 37.

A pressure-contact force of the applying roller 64 against the fixing roller 37 is not limited to a particular value, but preferably in a range of 0.05 to 1.0 N/cm in terms of a liner pressure. When the pressure-contact force is less than 0.05 N/cm, a contact state between the applying roller 64 and the fixing roller 37 becomes unstable so that the fixer fluid 50 cannot possibly be applied evenly to the surface of the fixing roller 37. Further, the applying roller 64 cannot be elastically deformed in conformity with minute concavities and convexities in the surface of the fixing roller 37 and especially, the fixer fluid 50 cannot be sufficiently applied to the concavities, which may possibly lead generation of unevenness in the application. On the other hand, when the pressure-contact force exceeds 1.0 N/cm, the fixer fluid 50 on the surface of the applying roller 64 cannot pass through a pressure-contact portion between the applying roller 64 and the fixing roller 37 which are rotating in pressure-contact with each other. As a result, the fixer fluid 50 forms meniscus at an entrance of the pressure-contact portion, and excess fixer fluid 50 flows back to an upstream side in a rotation direction of the applying roller 64 so that the fixer fluid 50 cannot possibly be applied evenly to the surface of the fixing roller 37. In the embodiment, a press force (the pressure-contact force) of the applying roller 64 against the fixing roller 37 is 0.1 N/cm in terms of a linear pressure.

The shaft 65 may be realized by the use of a shaft construction for common use in the field of interest. In the embodiment, it is possible to use an aluminum-made which is 30 mm in an outer diameter and 0.5 mm in wall thickness. Further, the shaft 65 is provided with a plurality of passage holes 65*a* for letting the fixer fluid 50 therethrough. In the embodiment, 16 pieces of 0.1 mm-diameter passage holes 65*a* are provided on positions which are equiangularly located, that is, at 22.5 degree-intervals in a circumferential direction of the shaft 65 and which are located at 5-mm intervals in an axial direction of the shaft 65. Note that a group of the passage holes 65*a* in one axial transverse section are shifted by half a phase, that is, 11.25 angles in the circumferential direction from the passage holes 65*a* in another axial transverse section, which are adjacent to the passage holes 65*a* in one axial transverse section. In an internal space of the shaft 65 is retained and stored the fixer fluid 50. Accordingly, the shaft 65 functions as a fixer fluid storage section.

The permeation control layer 66 is elastically deformable and able to permeate the fixer fluid 50 therewith and retain the fixer fluid 50 therein in order to prevent the fixer fluid 50 which is supplied from the passage hole 65*a* of the shaft 65, from being excessively supplied to the porous layer 67. For the permeation control layer 66, there is used, for example, a felt material or a continuously-foamed rubber material (sponge). In the embodiment, a 5-mm thick felt is used. Further, in the embodiment, a Young modulus of the permeation control layer 66, which is an indicator of an elastic body, is 3 MPa which is 1/100 or less as small as that of the toner 16. Since the permeation control layer 66 has pores being capable of retaining the fixer fluid 50 therein, it is possible to change an application amount of the fixer fluid 50 according to a surface condition of a to-be-contacted object. When a surface area of the to-be-contacted object is large, a large amount of the fixer fluid 50 is supplied to the porous layer 67. On the other hand, when the surface area of the to-be-contacted object is small, a small amount of the fixer fluid 50 is supplied to the porous layer 67.

The porous layer 67 is formed of materials which are elastically deformable and capable of being made porous. Such materials include PTFE, polyurethane, and polyimide, for example. A diameter of the pore of the porous layer 67 is not limited to a particular value, but preferably selected from values ranging from 0.1 μm to 2 μm. When the diameter of the pore is less than 0.1 μm, a permeation amount of the fixer fluid 50 is small so that sufficiently high fixation strength of the toner image cannot possibly be attained. On the other hand, when the diameter of the pore exceeds 2 μm, the toner particle may possibly be stuck in the pore, resulting in clogging. A pore ratio of the porous layer 67 is not limited to a particular value either, but preferably selected from values ranging from 60% to 90%. When the pore ratio is less than 60%, the retention amount and permeation amount of the fixer fluid 50 are small so that sufficiently high fixation strength of the toner image, especially containing a large amount of the toner, cannot possibly be attained. On the other hand, when the pore ratio exceeds 90%, it is difficult to form the porous layer 67 having resilience of an elastic body. Further, a thickness of the porous layer is not limited to a particular value either, but preferably selected from values ranging from 10 to 200 μm. When the thickness of the porous layer is less than 10 μm, it is difficult to form the porous layer. On the other hand, when the thickness of the porous layer exceeds 200 μm, the permeation amount of the fixer fluid 50 is small so that sufficiently high fixation strength of the toner image cannot possibly be attained. In the embodiment, there is used a PTFE-made porous film having a thickness of 50 μm, a pore diameter of 0.5 μm, and a pore ratio of 80%.

Moreover, it is preferable that a contact angle of the fixer fluid 50 with respect to the porous layer 67 be smaller than a contact angle of the surface of the fixing roller 37 with respect to the fixer fluid 50. By so doing, when the porous layer 67 and the fixing roller 37 are made into contact with each other, the fixer fluid 50 is attached to the porous layer 67 more easily than it is to the fixing roller 37 so that a minimum amount of the fixer fluid 50 is applied to the fixing roller 37, and a usage of the fixer fluid 50 is thus reduced. This makes it possible to decrease a frequency of replenishing the fixer fluid 50. A difference in the contact angle between the porous layer 67-fixer fluid 50 and the fixing roller 37-fixer fluid 50 is preferably 5 degrees or more. Further, in the embodiment, the contact angle of the surface of the porous layer 67 with respect to the fixer fluid 50 is set at 65 degrees. Note that, in the embodiment, the porous layer 67 never comes into direct contact with the toner image, but if the porous layer 67 comes into direct contact with the toner image, the following advantage is obtained. That is, since the porous layer 67 retains the fixer fluid 50 so as to be movable in and out, the fixer fluid 50 never stagnates by forming meniscus at the entrance of the nip portion between the porous layer 67 and an image carrying member carrying the toner image. Accordingly, no flow of the fixer fluid 50 is generated in a state where the fixer fluid 50 and the toner image are in contact with each other, with the result that the toner image is free from irregularities and it is therefore possible to obtain an image of high quality and high resolution. Further, the fine pores of the porous layer 67 can retain the fixer fluid 50 therein, so that the application amount of the fixer fluid 50 can be changed in accordance with a surface condition of the to-be-contacted object. When the surface area of the to-be-contacted object is large, a large amount of the fixer fluid 50 is caused to ooze out from the porous layer 67, with the result that the application amount of the fixer fluid 50 is large per unit area in broad perspective. On the other hand, when the surface area of the toner image is small, only a small amount of the fixer fluid 50 is caused to ooze out from the porous layer 67, with the result that the application amount of the fixer fluid 50 is small per unit area in broad perspective.

Concerning the application of the fixer fluid 50 with respect to the fixing roller 37 conducted by the applying roller 64, preferable is not such a control as being selected from only two options of "applying" or "not applying", but such a control as to change the application amount at a sequential or multistep process. For example, there can be cited such a control as changing the application amount according to a surface temperature of the fixing roller 37. To be more specific, the control is conducted in such a way that when the surface temperature is less than 120° C., a ratio of the toner to the fixer fluid is adjusted to be 1:2 (by weight, which will be the same hereinafter), and when the surface temperature is 120° C. or more and less than 140° C., the ratio is 1:1.5, and when the surface temperature is 140° C. or more and less than 160° C., the ratio is 1:1, and when the surface temperature is 160° C. or more and less than 170° C., the ratio is 1:0.5, and when the surface temperature exceeds 170° C., no fixer fluid is applied. The control of the application amount of the fixer fluid 50 is conducted, as will be described hereinafter, by changing as appropriate a press force of the applying roller 64 with respect to the fixing roller 37, for example, through adjustment of a position of the support plate 63 or adjustment of a spring force of a press spring 71.

Further, on both ends in a longitudinal direction of an upper part in a vertical direction of the casing 62 are provided pivots 68*a*, 68*b*. The pivots 68*a*, 68*b* are slidably inserted into U-shaped guide grooves 69*a*, 69*b* provided on a side of the support plate 63, facing the casing 62. The pivots 68*a*, 68*b* slide in the guide grooves 69*a*, 69*b* whereby the casing 62 moves in a direction indicated by an arrow 70 so that the applying roller 64 is brought to an operating position where the applying roller 64 is in contact with the fixing roller 37. When the pivots 68*a*, 68*b* are positioned at ends of the guide grooves 69*a*, 69*b*, the applying roller 64 is at the operating position. The casing 62 is realized in a form of a detachable cartridge. When a sensor (not shown) detects that all of the fixer fluid 50 inside the applying roller 64 has been consumed, and the detected result is sent to the CPU 23 which then exhibits, in accordance with detected result, an arrival of time for replacing the casing 62 onto an operating panel (not shown) provided on an upper surface of the image forming apparatus 60. On the basis of such an indication, the user replaces the casing 62.

The support plate 63 includes a platy member 63*a*, and a rotary shaft 63*b* for supporting the platy member 63*a*. The rotary shaft 63*b* is rotatably supported about its shaft center by a driving section (not shown). The platy member 63*a* can rotate about the rotary shaft 63*b* in a direction indicated by an arrow 72. This makes it possible to attach/detach the fixing roller 37 to/from the applying roller 64 and to adjust the press force of the fixing roller 37 with respect to the applying roller 64. On a side surface of the support plate 63, facing the casing 62, are provided the guide grooves 69*a*, 69*b* and the press spring 71. In a case where the support plate 63 is positioned in parallel with the side surface opposite to the side surface 62*a* of the casing 62, the pivots 68*a*, 68*b* are fit in the guide grooves 69*a*, 69*b*, and the press spring 71 presses a surface lower in a vertical direction of the casing 62. In the case, the casing 62 is rotatably supported about the pivots 68*a*, 68*b*. By so doing, the applying roller 64 inside the casing 62 is brought into pressure-contact with the fixing roller 37 under a predetermined press force. This press force can be adjusted by changing types of the press spring 71, for example. Usable examples of the press spring 71 include a coil spring, a leaf spring, and a torsion spring. The support plate 63, the pivots 68*a* and 68*b*, the guide grooves 69*a*, 69*b* and the press spring 71 constitute an attaching/detaching section.

In the wet fixing section 7*a*, an appropriate amount of the fixer fluid 50 is applied evenly to the surface of the fixing roller 37.

In the embodiment, there is employed a constitution such that a retention-storage layer for the fixer fluid 50 is provided inside the applying roller 64, and the casing 62 including the applying roller 64 is replaced to replenish the fixer fluid 50. However, the constitution is not limited to the above constitution, and there may be employed a constitution such that a fixer fluid storage tank (not shown) for storing the fixer fluid is provided inside the image forming apparatus 60, and the fixer fluid storage tank is connected to the applying roller 64 by piping through which the fixer fluid 50 is supplied from the fixer fluid storage tank.

In the embodiment, the fixer fluid applying member 61 is used to apply the fixer fluid 50 to the surface of the fixing roller 37, but a component for applying the fixer fluid 50 is not limited to the fixer fluid applying member 61, and may be a nozzle head array, an ultrasonic sprayer, a spray nozzle using an air current, or the like member.

In the embodiment, the fixing roller 37 has functions not only for heating and thus fusing the unfixed toner image on the recording material 9 so as to fix the unfixed toner image on the recording material 9, but also as a fixer fluid applying member for applying the fixer fluid 50 to the unfixed toner image.

Accordingly, it is preferable that at least a surface layer of the fixing roller 37 be formed of a material which is not impregnated with the fixer fluid 50. This makes it possible to prevent the fixer fluid 50 from permeating the recording material 9, resulting in decrease in the usage of the fixer fluid 50, and moreover to apply the fixer fluid 50 effectively to the surface of the fixing roller 37.

Further, it is preferable that the contact angle of the fixing roller 37 with respect to the fixer fluid 50 be set to be larger than the contact angle of the toner 16 with respect to the fixer fluid 50. By so doing, when the fixing roller 37 carrying on a surface thereof the fixer fluid 50 is brought into contact with the toner image, the fixer fluid 50 is more easily attached to the toner image so that the fixer fluid 50 can be sufficiently applied to the toner image. A difference in the contact angle between the fixing roller 37-fixer fluid 50 and the toner 16-fixer fluid 50 is preferably 10 degrees or more. Further, the fixer fluid 50 is present between the fixing roller 37 and the toner image which are brought into contact with each other, with the result that the toner is attached to the fixing roller 37 with difficulty.

The temperature sensor 40 for detecting the surface temperature of the fixing roller 37 outputs the result of detected temperature to the CPU 23 for controlling an entire operation of the image forming apparatus 60. The CPU 23 includes a storing section, a determining section, and a control section (none of which are shown). In the storing section are stored a predetermined fixing temperature, result of temperatures as previously and currently detected, and other factors. In the determining section, the currently-obtained result of detected temperature is compared with any one of the predetermined fixing temperature, the result of previously-detected temperature, a boiling point of a main solvent of the fixer fluid 50, the softening point and glass transition temperature of the toner 16, and the like factors, to thereby determine which temperature is higher than the other. The control section sends a control signal in accordance with a result determined by the determining section to thereby control an operation of the wet fixing section 7*a*.

For example, in a case where the determining section determines that the result of currently-detected temperature is higher than the result of previously-detected temperature, the control section sends a control signal to a driving section (not shown) for rotating the rotary shaft 63*b* of the support plate 63, whereby the rotary shaft 63*b* and further the platy member 63*a* are made to rotate in the direction indicated by the arrow 72 so that a contact pressure of the applying roller 64 against the fixing roller 37 is lowered, and the application amount of the fixer fluid from the applying roller 64 to the fixing roller 37 is reduced, with the result that the application amount of the fixer fluid to the unfixed toner image is indirectly reduced. On the other hand, in accordance with a result that the currently-detected temperature is lower than the result of previously-detected temperature, the control section rotates the platy member 63*a* in a direction opposite to the direction indicated by the arrow 72, and increases the contact pressure of the applying roller 64 against the fixing roller 37, and indirectly increases the application amount of the fixer fluid to the unfixed toner image.

Further, in accordance with a result that the currently-obtained detected temperature is higher than the predetermined fixing temperature, the control section rotates the platy member 63*a* in the direction detected by the arrow 72 until the applying roller 64 is moved completely away from the fixing roller 37, and moreover stops the fixing roller 37 and further stops the applying operation of the fixer fluid 50 to the unfixed toner image on the recording material 9.

Further, in a state where the surface temperature of the fixing roller 37 is so low at the time of start-up and during a recovering operation from a left state of the image forming apparatus 60 that the heat fixing operation of the toner image cannot be performed, the contact pressure of the applying roller 64 against the fixing roller 37 is adjusted as appropriate by rotation of the platy member 63*a* so that the application amount of the fixer fluid from the fixing roller 37 to the toner image satisfies the following condition: a ratio of the toner amount of the toner image to the application amount of the fixer fluid is about 1:2 (by weight). Further, in a case where the surface temperature of the fixing roller 37 is higher than the predetermined fixing temperature, there is normally performed only the heat fixing operation conducted by the fixing roller 37. However, in a high-speed machine whose output number of sheets per minute exceeds 60, attributable to such continuous image formations, the surface temperature of the fixing roller 37 may be lower than the predetermined fixing temperature. This kind of temperature decrease is detected by the temperature sensor 40 and in accordance with such a result of detected temperature, the control section conducts a control of making the applying roller 64 into contact with the fixing roller 37. And then, both of the heat fixing operation and the wet fixing operation are performed. Subsequently, the surface temperature of the fixing roller 37 rises up to a level around the predetermined fixing temperature or higher, and when the fixing roller 37 is ready for the heat fixing operation, the applying operation of the fixer fluid 50 is brought to a stop, and the operation is shifted to the heat fixing operation. By repeating this process, it is possible to stably keep a state where a throughput is high, continuously after the start-up.

Note that the control section controls the surface temperature of the fixing roller 37 as in the case of the image forming apparatus 1.

At the fixing nip portion between the fixing roller 37 and the pressuring roller 39, the toner constituting the toner image on the recording material 9 is swelled/softened instantly after being subjected to heat and/or application of the fixer fluid 50 and at the same time, pressurized to be therefore fixed solidly on the recording material 9. The pressure (press) at the transferring nip portion helps the swelled/softened toner get deeply into fibers constituting the recording material 9, and at the same time, the toner particles are mutually fused to form a toner image having a smooth surface. In this way, by virtue of the subtractive color mixing process, it is possible to obtain a high-quality color image which is excellent in coloration and in surface glossiness.

As described above, there is employed a constitution such that the fixer fluid 50 is applied to the toner image on the recording material 9 by way of the fixing roller 37. This makes it possible to prevent paper powder such as paper fiber from being attached to the surface of the applying roller 64, i.e., to prevent clogging from occurring. As a result, the fixer fluid 50 is applied evenly to the surface of the fixing roller 37, so that images of high quality can be stably formed at any time.

Further, when the fixer fluid 50 is applied to the toner image by the fixing roller 37, the fixer fluid 50 is applied also to fogging toner attached to the non-image portion. As a result, as well as the toner on the image portion, the fogging toner is also fixed on the recording material 9. This makes it possible to prevent the fogging toner from being attached to hands, clothes, and other things.

Figure 6:
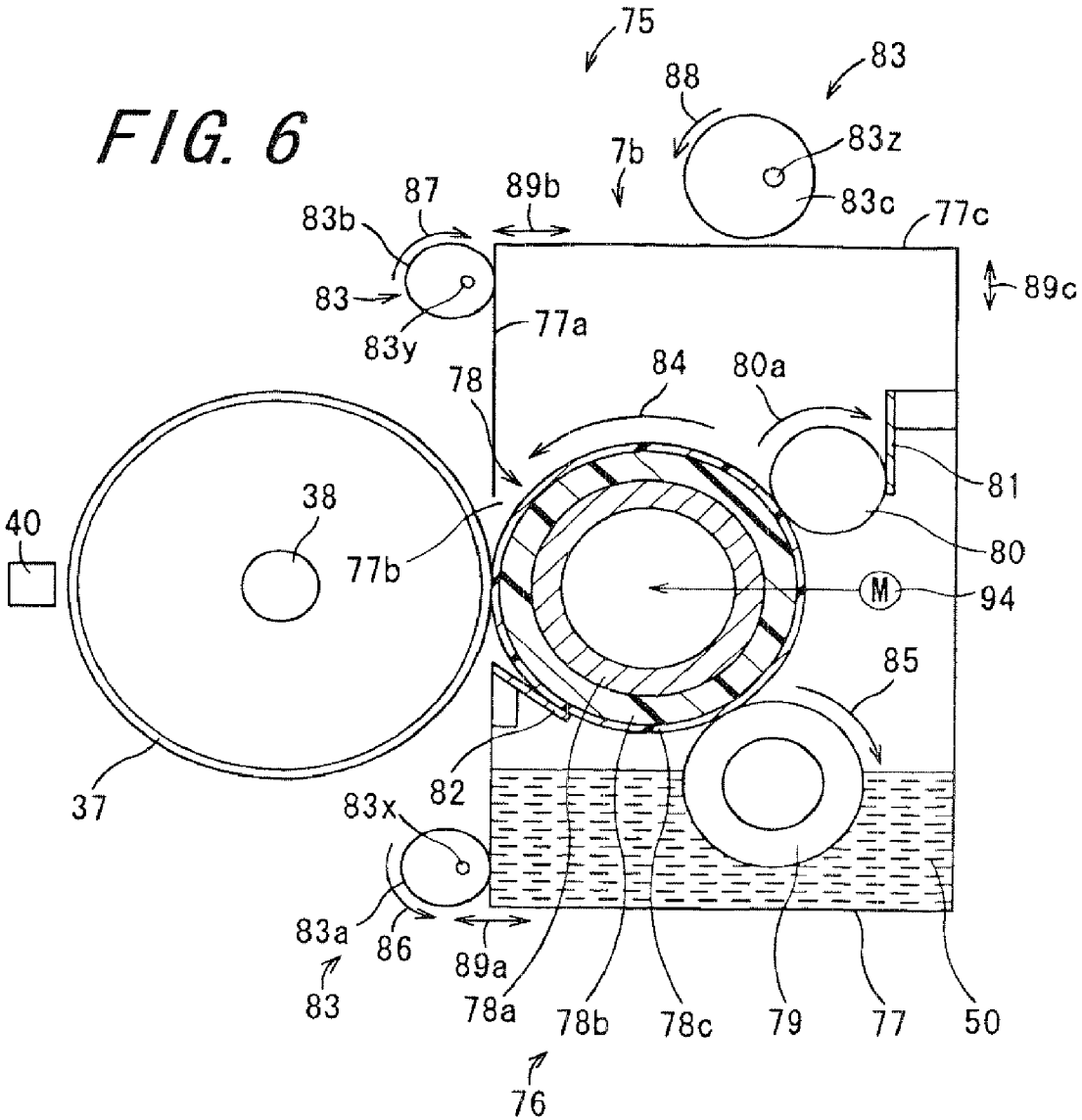
FIG. 6 is a sectional view schematically showing a constitution of an image forming apparatus according to a third embodiment.

FIG. 6 is a sectional view schematically showing a constitution of an image forming apparatus 75 according to a third embodiment. The image forming apparatus 75 is similar to the image forming apparatus 60. Therefore, the components that play the same or corresponding roles as in the image forming apparatus 60 will be denoted by the same reference numerals, and descriptions thereof will be omitted.

The image forming apparatus 75 is characterized in having a wet fixing section 7*b* instead of the wet fixing section 7*a* which includes the fixer fluid applying member 61 detachably provided on the surface of the fixing roller 37 in the heat fixing section 6 of the image forming apparatus 60. The wet fixing section 7*b* includes a fixer fluid applying member 76 detachably provided on the surface of the fixing roller 37. The image forming apparatus 75 has basically the same constitution as that in the image forming apparatus 60 other than the wet fixing section 7*b*.

The wet fixing section 7*b* includes the fixer fluid applying member 76 and an attaching/detaching member 83 serving as an attaching/detaching section.

The fixer fluid applying member 76 includes a fixer fluid reservoir 77 serving as a fixer fluid storage section, an applying roller 78 serving as an applying member, a fixer fluid supplying roller 79, a fixer fluid regulating roller 80, a first sealing member 81, and a second sealing member 82.

The fixer fluid reservoir 77 is supported by an attaching/detaching member 83 so as to be movable in a vertical direction and/or a horizontal direction. The fixer fluid reservoir 77 has an opening 77*b* formed therein, specifically on a side surface 77*a* thereof facing the fixing roller 37. Through the opening 77*b*, a part of the applying roller 78 protrudes to outside of the fixer fluid reservoir 77 and comes into pressure-contact with the fixing roller 37. Moreover, in a lower part in a vertical direction of the fixer fluid reservoir 77, there is formed a fixer fluid receiver where the fixer fluid 50 is stored. In response to fixer-fluid 50 consumption conditions, the fixer fluid receiver is replenished with the fixer fluid 50, through piping from a fixer fluid storage tank (not shown), until the fixer fluid 50 reaches a predetermined level. By thus providing a separate section for storing the fixer fluid 50 other than the fixer fluid applying member 76, it is possible to store a large amount of the fixer fluid 50, allowing decrease in a frequency of replenishing the fixer fluid 50.

The applying roller 78 is a roller member supported by a driving section (not shown) so as to be rotatable in a direction indicated by an arrow 84, and is in pressure-contact with the fixing roller 37. The applying roller 78 is used to apply the fixer fluid 50 to the surface of the fixing roller 37. The applying roller 78 is composed of a shaft 78*a*, a fixer fluid retaining layer 78*b* formed on a surface of the shaft 78*a*, and a porous layer 78*c* formed on a surface of the fixer fluid retaining layer 78*b*.

For the shaft 78*a*, it is possible to use a metal-made shaft which is commonly used in the field of the electrophotographic image forming apparatus.

The fixer fluid retaining layer 78*b* receives the fixer fluid 50 supplied from the fixer fluid supplying roller 79 via the porous layer 78*c*, and retains the received fixer fluid 50. In accordance with decrease in an amount of the fixer fluid 50 retained by the porous layer 78*c*, the fixer fluid retaining layer 78*b* supplies the fixer fluid 50 to the porous layer 78*c*. The fixer fluid retaining layer 78*b* is formed of materials such as a felt and continuously-foamed rubber, which have a liquid absorbing property and elasticity. By providing the fixer fluid retaining layer 78*b*, a sufficient amount of the fixer fluid 50 can be retained in the applying roller 78 as a whole even when the porous layer 78*c* retains a small amount of the fixer fluid 50, with the result that an appropriate amount of the fixer fluid 50 can be applied to the surface of the fixing roller 37.

The porous layer 78*c* has therein a large number of fine pores which retain a part of the fixer fluid 50 supplied from the fixer fluid supplying roller 79 while the rest of the fixer fluid 50 is supplied to the fixer fluid retaining layer 78*b*. The fixer fluid 50 retained in the porous layer 78*c* is applied to the surface of the fixing roller 37 at a pressure-contact portion between the applying roller 78 and a fixing roller 37. A contact angle of the porous layer 78*c* with respect to the fixer fluid 50 is preferably set at 80 degrees or less. When the contact angle exceeds 80 degrees, it is difficult for the fixer fluid 50 to permeate the porous layer 78*c*, leading insufficient retainment of the fixer fluid 50, insufficient supply of the fixer fluid 50 to the fixer fluid retaining layer 78*b*, and insufficient application of the fixer fluid 50 to the fixing roller 37. The porous layer 78*c* may be constituted, for example, by forming only a surface layer thereof into a porous film having fine pores, and forming an inner portion thereof of materials such as felt and continuously-foamed rubber.

In the embodiment, there is used the applying roller 78 composed of: the shaft 78*a* having a diameter of 14 mm; the fixer fluid retaining layer 78*b* which is a felt layer (3 MPa of elastic modulus) having a thickness of 3 mm; and the porous layer 78*c* which is a urethane resin-made porous film having a thickness of 0.1 mm. An outer diameter of a laminate made of the shaft 78*a* and the fixer fluid retaining layer 78*b* stacked on the shaft 78*a* is 20 mm. The porous layer 78*c* is stacked on a surface of the fixer fluid retaining layer 78*b*. Further, a press force of the applying roller 78 against the fixing roller 37 is 0.5 N/cm in terms of a linear pressure. Furthermore, the applying roller 78 rotates at substantially the same velocity as that of the fixing roller 37.

A driving section (not shown) for the applying roller 78 includes, for example, a motor, a gear train, and a driving belt. Such a driving section contributes to adjust a circumferential velocity of the applying roller 78 to substantially the same as that of the intermediate transfer belt 21.

An amount of the fixer fluid applied to the fixing roller 37 through the applying roller 78 can be adjusted, for example, by changing a contact pressure of the fixer fluid regulating roller 80 against the applying roller 78, and changing a contact pressure of the applying roller 78 against the fixing roller 37 by means of subsequently-explained attaching/detaching member 83.

The fixer fluid supplying roller 79 is a roller member which is supported by a driving section (not shown) so as to be rotatable in a direction indicated by an arrow 85, that is opposite to the direction indicated by the arrow 84, and bought into pressure-contact with the applying roller 78. The fixer fluid supplying roller 79 is provided so that a part thereof is dipped in the fixer fluid 50 contained in the fixer fluid receiver in the lower part in the vertical direction of the fixer fluid reservoir 77. The fixer fluid supplying roller 79 rotates in the direction indicated by the arrow 85 to thereby supply, at the pressure-contact portion between the fixer fluid supplying roller 79 and the applying roller 78, the fixer fluid 50 attached on the surface of the fixer fluid supplying roller 79, to the porous layer 78*c* in a surface of the applying roller 78. By employing such a configuration that the fixer fluid 50 is supplied to an outer surface of the applying roller 78, the fixer fluid 50 no longer needs to be retained and stored in an inner space of the applying roller 78, with the result that the applying roller 78 can have a simplified and downsized constitution. For the fixer fluid supplying roller 79, there is used, for example, a roller member composed of a shaft and a resin foam layer stacked on a surface of the shaft. In the embodiment, there is used a sponge roller composed of a shaft having a diameter of 10 mm and a urethane resin-made continuous foam having a thickness of 5 mm stacked on a surface of the shaft.

The fixer fluid regulating roller 80 is a roller member which is supported by a driving section (not shown) so as to be rotatable in a direction indicated by an arrow 80*a*, that is opposite to the direction indicated by the arrow 84, and brought into pressure-contact with the applying roller 78. The fixer fluid regulating roller 80 is used to adjust an amount of the fixer fluid 50 retained in the porous layer 78*c* in a surface layer of the applying roller 78 so as to be appropriate, and moreover to equalize the fixer fluid 50 in the porous layer 78*c*. For the fixer fluid regulating roller 80, there is used a metal-made roller, for example. In the embodiment, there is used, for example, a stainless steel-made roller having an outer diameter of 12 mm. By providing the fixer fluid regulating roller 80, it is possible to prevent partial fixing failure of the toner image attributable to formation of meniscus of the fixer fluid 50 at an entrance of the pressure-contact portion between the applying roller 78 and the fixing roller 37, resulting in reflux of the fixer fluid 50 and as a consequence whereof the fixer fluid 50 is attached unevenly to the surface of the fixing roller 37. Accordingly, it is possible to obtain an image of high quality and high resolution. In the embodiment, for the fixer fluid regulating roller 80, there is used a stainless steel-made roller member having an outer diameter of 12 mm.

The first sealing member 81 has one end thereof abutting on a surface of the fixer fluid regulating roller 80; and the other end thereof supported by the fixer fluid reservoir 77. The first sealing member 81 is a platy member for removing and collecting the fixer fluid 50 from the surface of the fixer fluid regulating roller 80. The fixer fluid 50 removed by the first sealing member 81 from the surface of the fixer fluid regulating roller 80 is low in viscosity and therefore coursing down the first sealing member 81 to eventually drop into the fixer fluid receiver in the lower part in the fixer fluid reservoir 77 where the fixer fluid 50 is collected. Moreover, the first sealing member 81 is one of linked elements including the applying roller 78, the fixer fluid regulating roller 80, and the second sealing member 82, to form a closed space inside the fixer fluid reservoir 77 so that the fixer fluid 50 is prevented from troubles such as drying and leaking to outside of the fixer fluid reservoir 77. In the embodiment, there is used a urethane rubber-made sheet having a thickness of 40 μm.

The second sealing member 82 is a platy member having one end thereof abutting on a surface of the applying roller 78; and the other end thereof supported by the fixer fluid reservoir 77. The second sealing member 82 is one of the linked elements including the applying roller 78, the fixer fluid regulating roller 80, and the first sealing member 81, to form the closed space inside the fixer fluid reservoir 77 so that the fixer fluid 50 is prevented from troubles such as drying and leaking to outside of the fixer fluid reservoir 77. In the embodiment, there is used a urethane rubber-made sheet having a thickness of 40 μm.

In the fixer fluid applying member 76, the porous layer 78*c* of the applying roller 78 receives the fixer fluid 50 supplied from the fixer fluid supplying roller 79 and further, the amount of the fixer fluid 50 retained in the porous layer 78*c* is adjusted by the fixer fluid regulating roller 80 and then, the fixer fluid 50 is applied to the surface of the fixing roller 37 in contact with the applying roller 78.

In the embodiment, there is employed a constitution such that the fixer fluid 50 is supplied to the applying roller 78 by way of the fixer fluid supplying roller 79. However, there is not limitation imposed on the selection of the constitution, and there may be employed a constitution such that no fixer fluid supplying roller 79 is provided but a part of the applying roller 78 is dipped in the fixer fluid 50 to supply the fixer fluid 50 directly to the applying roller 78. In this case, it is possible to realize, for example, a simple configuration and reduction in manufacturing cost.

The attaching/detaching member 83 is composed of an eccentric cams 83*a*, 83*b*, and 83*c*. Although not shown, on an opposite side of the eccentric cams with the fixer fluid reservoir therebetween are provided press springs for pressing the fixer fluid reservoir toward the eccentric cams. The eccentric cam 83*a* is supported by a driving section (not shown) so as to be rotatable in a direction indicated by an arrow 86 about a rotary shaft 83*x*. The eccentric cam 83*a* abuts on a lower portion in the vertical direction of the side surface 77*a* of the fixer fluid reservoir 77. The eccentric cam 83*b* is supported by a driving section (not shown) so as to be rotatable in a direction indicated by an arrow 87 about a rotary shaft 83*y*. The eccentric cam 83*b* abuts on an upper portion in a vertical direction of the side wall 77*a* of the fixer fluid reservoir 77. The eccentric cam 83*c* is supported by a driving section (not shown) so as to be rotatable in a direction indicated by an arrow 88 about a rotary shaft 83*z*. The eccentric cam 83*c* is provided detachably on an upper surface 77*c* in the vertical direction of the fixer fluid reservoir 77. The eccentric cam 83*a* rotates to thereby move the lower portion of the side surface 77*a* in the vertical direction of the fixer fluid reservoir 77, in a direction indicated by an arrow 89*a* (a horizontal direction). The eccentric cam 83*b* rotates to thereby move the upper part of the side surface 77*a* in the vertical direction of the fixer fluid reservoir 77, in a direction indicated by an arrow 89*b* (a horizontal direction). By so doing, it is possible to adjust attaching/detaching movements of the applying roller 78 with respect to the fixing roller 37 and the contact pressure (press force) of the applying roller 78 against the fixing roller 37. Further, the eccentric cam 83*c* rotates to thereby move the upper surface 77*c* in the vertical direction of the fixer fluid reservoir 77, in a direction indicated by an arrow 89*c* (a vertical direction). The eccentric cams 83*a*, 83*b*, and 83*c* may rotate in conjunction with each other. Alternatively, given one or two cams of the eccentric cams 83*a*, 83*b*, and 83*c* may rotate. That is to say, any cams of the eccentric cams 83*a*, 83*b*, and 83*c* may be selected to rotate, depending on various circumstances such as change of an applied amount of the fixer fluid applied from the applying roller 78 to the fixing roller 37, detachment of the applying roller 78 from the fixing roller 37 at a wet fixing occasion (a pause of the wet fixing operation), and abutment of the applying roller 78 onto the fixing roller 37 in the pause of the wet fixing operation.

A control on rotation of the attaching/detaching member 83 is conducted by a CPU (not shown) for controlling an entire operation of the image forming apparatus 75. The CPU includes, as in the case of the image forming apparatuses 1 and 60, a storing section, a determining section and a control section. In the storing section are stored the result of temperature detected by the temperature sensor 40, the boiling point of the main solvent of the fixer fluid 50, and the softening point and glass transition temperature of the toner 16. In the determining section, the result of detected temperature is compared with other data stored in the storing section. The control section controls the operation in accordance with the result determined by the determining section. For example, in accordance with the determined result, the control section outputs a control signal to a driving section (not shown) for driving the eccentric cams 83*a*, 83*b*, and 83*c*, to thereby control designation of a to-be-rotated eccentric cam, an angle of rotation thereof, and other factors. The control conducted by the CPU is effected as in the cases of the image forming apparatuses 1 and 60. For example, in a case where the surface temperature of the fixing roller 37 is as low as 60° C. or less, the fixer fluid 50 is applied to the fixing roller 37 so that the application amount of the fixer fluid from the fixing roller 37 to the toner image on the recording material 9 satisfies the following condition: a ratio of the toner amount of the toner image to the application amount of the fixer fluid is 1:1 (by weight). As the surface temperature of the fixing roller 37 rises, the above ratio to be satisfied is changing, that is, when the surface temperature is 80° C., the control is conducted so as to satisfy a ratio of 1:0.5, and when the surface temperature is 100° C., the control is conducted so as to satisfy a ratio of 1:0.2, and furthermore when the surface temperature is 160° C., the applying roller 78 is moved away from the fixing roller 37 to stop the applying operation of the fixer fluid 50.

In the image forming apparatus 75, according to the surface temperature of the fixing roller 37, the unfixed toner image transferred on the recording material 9 is subjected to one or both of the wet fixing operation and the heat fixing operation. By conducting such a control, even when the apparatus has been just started up or even while the apparatus is in pause, it is possible to smoothly perform an image forming operation, with the result that an image of high quality can be formed at any time.

Figure 7:
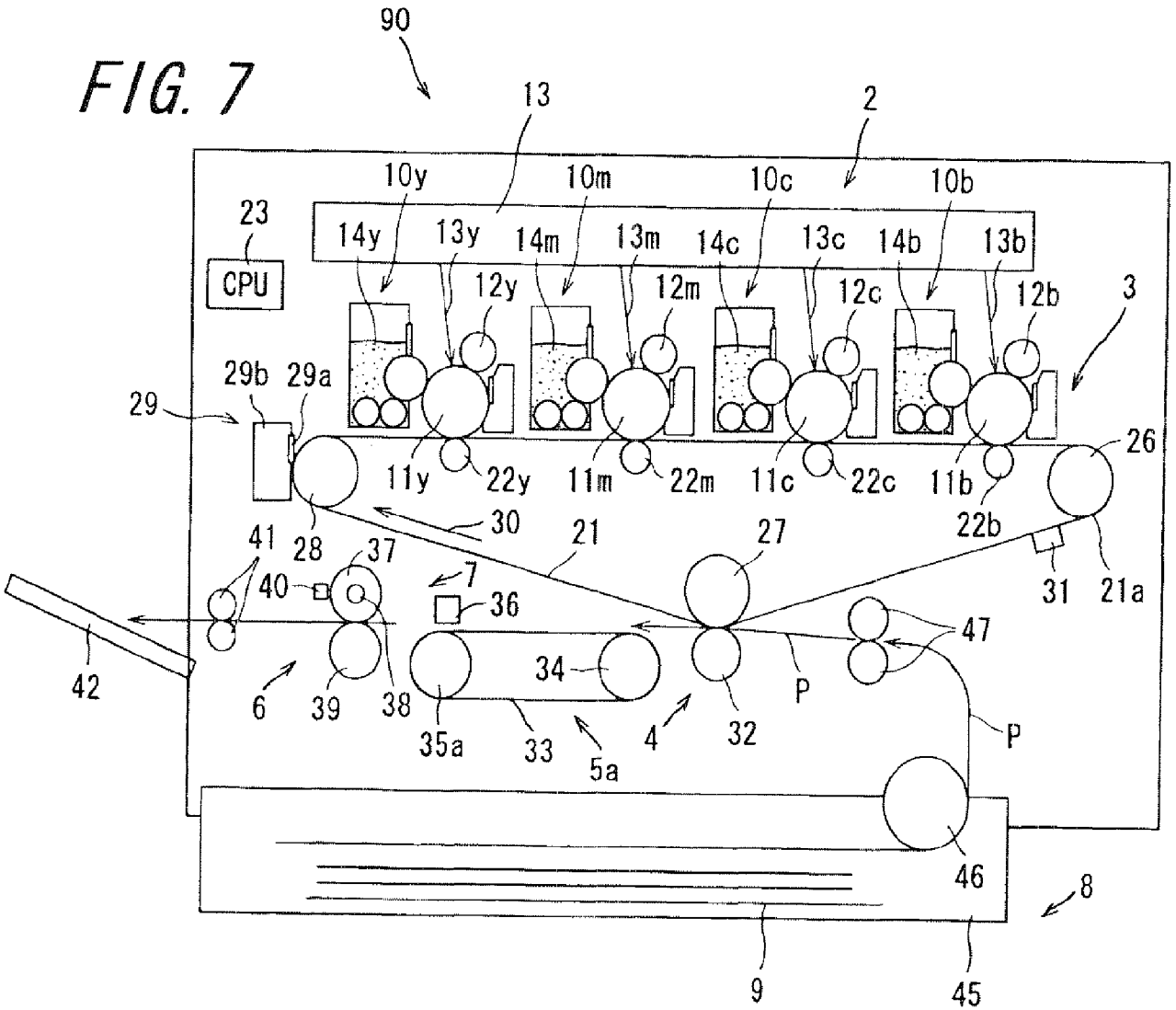
FIG. 7 is a sectional view schematically showing a constitution of an image forming apparatus according to a fourth embodiment.

FIG. 7 is a sectional view schematically showing a constitution of an image forming apparatus 90 according to a fourth embodiment. The image forming apparatus 90 is similar to the image forming apparatus 60. Therefore, the components that play the same or corresponding roles as in the image forming apparatus 60 will be denoted by the same reference numerals, and descriptions thereof will be omitted.

The image forming apparatus 90 is characterized in that, not like the image forming apparatus 60 where the wet fixing section 7*a* is brought into contact with the surface of the fixing roller 37 in the heat fixing section 6 to thereby apply the fixer fluid 50 to the surface of the fixing roller 37, but there is provided a wet fixing section 7 for applying the fixer fluid 50, which is not in contact with the surface of the fixing roller 37 but disposed above the conveyance belt 33 in the recording material conveying section 5*a*, and in accordance with the result of surface temperature of the fixing roller 37 detected by the temperature sensor 40, the fixer fluid 50 is applied or not applied to the unfixed toner image on the recording material 9 which is placed on the conveyance belt 33 to be thereby conveyed further to the heat fixing section 6 where the toner image is fixed on the recording material 9.

The wet fixing section 7 includes the nozzle head array 36. The nozzle head array 36 applies the fixer fluid 50 to the recording material 9 which carries the unfixed toner image and is placed on the conveyance belt 33. Concerning the application of the fixer fluid 50 with respect to the fixing roller 37 conducted by the nozzle head array 36, preferable is not such a control as being selected from only two options of "applying" or "not applying", but such a control as to change the application amount at a sequential or multistep process. For example, there can be cited such a control as changing the application amount according to the surface temperature of the fixing roller 37. To be more specific, the control is conducted in such a way that when the surface temperature is less than 120° C., a ratio of the toner to the fixer fluid is adjusted to be 1:2 (by weight, which will be the same hereinafter), and when the surface temperature is 120° C. or more and less than 140° C., the ratio is 1:1.5, and when the surface temperature is 140° C. or more and less than 160° C., the ratio is 1:1, and when the surface temperature is 160° C. or more and less than 170° C., the ratio is 1:0.5, and when the surface temperature exceeds 170° C., no fixer fluid is applied. The amount of the fixer fluid applied by the nozzle head array 36 can be adjusted by selecting as appropriate an electric quantity supplied to the nozzle head array 36.

A fixer fluid applying operation conducted by the nozzle head array 36 is effected by the CPU 23 as in the case of the image forming apparatuses 1 and 60. The CPU 23 includes a storing section, a determining section, and a control section. In the storing section are stored the result of surface temperature of the fixing roller 37 detected by the temperature sensor 40, and a predetermined fixing temperature (for example, 180° C.). In the determining section, the result of detected temperature is compared with other data stored in the storing section. The control section controls the operation in accordance with the result obtained by the determining section. The control section outputs a control signal to a power source (not shown) for supplying electricity to the nozzle head array 36 in accordance with the result determined by the determining section to thereby control operations such as a start of applying the fixer fluid, a stop of applying the fixer fluid, and increase and decrease of the application amount of the fixer fluid.

In the image forming apparatus 90, the unfixed toner image transferred on the recording material 9 is subjected to the wet fixing operation and the heat fixing operation in this order. At this time, in accordance with the surface temperature of the fixing roller 37, the application amount of the fixer fluid 50 during the wet fixing operation is changed, or alternatively the wet fixing operation is brought to a halt. By so doing, even when the apparatus has been just started up or even while the apparatus is in pause, the toner image is smoothly fixed on the recording material 9 which is then discharged to the tray 44.

Figure 8:
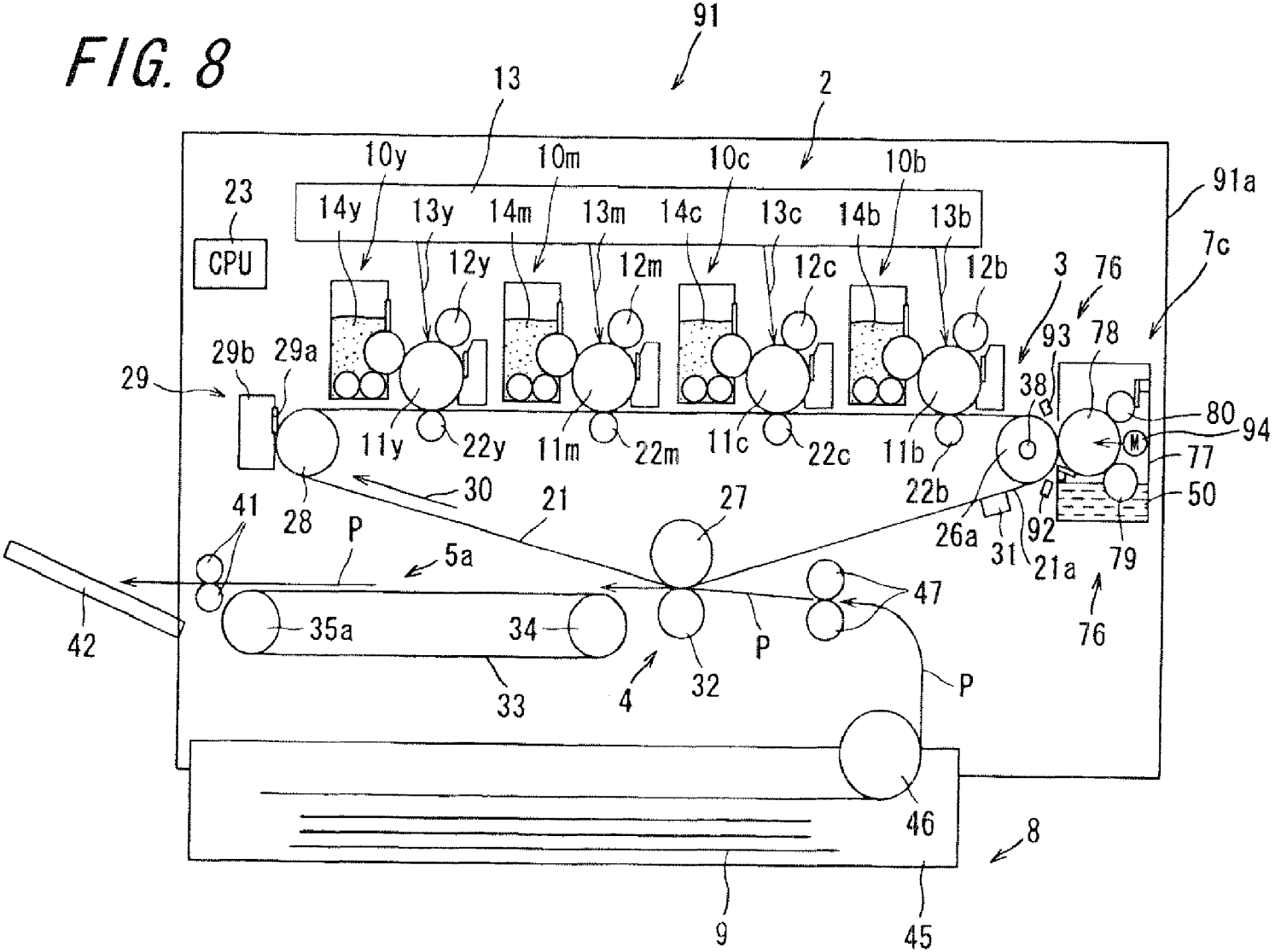
FIG. 8 is a sectional view schematically showing a constitution of an image forming apparatus according to a fifth embodiment.

FIG. 8 is a sectional view schematically showing a constitution of an image forming apparatus 91 according to a fifth embodiment. The image forming apparatus 91 is similar to the image forming apparatus 75. Therefore, the components that play the same or corresponding roles as in the image forming apparatus 75 will be denoted by the same reference numerals, and descriptions thereof will be omitted. Note that the attaching/detaching member 83 contained in the wet fixing section 7*c* will be omitted in FIG. 8.

The image forming apparatus 91 has the following four features: that is, 1) the fixer fluid applying member 76 contained in the wet fixing section 7*c* is not detachably provided on the surface of the fixing roller 37 in the heat fixing section 6, differently from the case of the image forming apparatus 75, but the fixer fluid applying member 76 faces a supporting roller 26*a* across the intermediate transfer belt 21 and is detachably provided on an image carrying surface 21*a* of the intermediate transfer belt 21 and moreover, at the time of coming into pressure-contact with the intermediate transfer belt 21, the fixer fluid applying member 76 applies the fixer fluid 50 to the toner image on the intermediate transfer belt 21 in contact with the fixer fluid applying member 76;

2) inside the supporting roller 26*a* is provided the heating section 38 which heats the intermediate transfer belt 21 and thus fuses the toner image on the intermediate transfer belt 21;

3) on a downstream side from the supporting roller 26*a* along the driving direction of the intermediate transfer belt 21, that is, the direction indicated by the arrow 30, is provided the temperature sensor 31 for detecting a temperature of the intermediate transfer belt 21, and according to the result detected by the temperature sensor 31, the attaching/detaching movements of the fixer fluid applying member 76 with respect to the intermediate transfer belt 21 are controlled, 4) the toner image is subjected to heat and application of the fixer fluid 50 into a fused state and then conveyed to the transferring section 4 and therefore, the transferring section 4 operates as a transfuse section with not only a function of transferring the toner image onto the recording material 9, but also a function of fixing the toner image onto the recording material 9; and 5) no heat fixing section 6 is provided.

The wet fixing section 7*c* includes the fixer fluid applying member 76, an attaching/detaching member (not shown), the temperature sensor 31, a passage detecting section 92, and a contact detecting section 93. The temperature sensor 31 is provided on the downstream side from a contact portion (which will be hereinafter referred to simply as an applying roller contact portion) between the intermediate transfer belt 21 and the applying roller 78 along the direction indicated by the arrow 30. The temperature sensor 31 detects the surface temperature of the intermediate transfer belt 21. The passage detecting section 92 is provided in the vicinity of the applying roller contact portion. The passage detecting section 92 detects that the toner image on the intermediate transfer belt 21 has passed through the applying roller contact portion. The contact detecting section 93 detects a contact state between the intermediate transfer belt 21 and the applying roller 78.

Configuration of the fixer fluid applying member 76 and attaching/detaching member are as described above. The attaching/detaching member brings the fixer fluid applying member 76 into contact with or away from the intermediate transfer belt 21, in accordance with the result of temperature of the intermediate transfer belt 21 detected by the temperature sensor 31.

The temperature sensor 31 is electrically connected to the CPU 23 for controlling an entire operation of the image forming apparatus 91, and outputs the detected result of the surface temperature of the intermediate transfer belt 21 to the CPU 23. In accordance with the detected result, the CPU 23 controls the attaching/detaching operation of the fixer fluid applying member 76 with respect to the intermediate transfer belt 21. The CPU 23 controls the attaching/detaching member as in the case of the image forming apparatus 75.

For the passage detecting section 92, a light sensor is used, for example. In accordance with the result detected by the passage detecting section 92, the applying roller 78 is controlled to abut on the intermediate transfer belt 21 or to move away from the intermediate transfer belt 21. Such a control on the movement of the applying roller 78 is conducted by the CPU 23 which is electrically connected to the passage detecting section 92. The CPU 23 includes a storing section, a determining section, and a control section. The result detected by the passage detecting section 92 is inputted to the storing section which then stores the detected result. The determining section determines, on the basis of the result detected by the passage detecting section 92, whether the toner image on the intermediate transfer belt 21 has passed through the contact portion between the intermediate transfer belt 21 and the applying roller 78. The control section outputs, in accordance with a result determined by the determining section, a control signal to a driving section (not shown) for rotating the attaching/detaching member, and controls the attaching/detaching movement of the fixer fluid applying member 76 effected by the attaching/detaching member with respect to the intermediate transfer belt 21. For example, in a case where the determining section determines as a result that the toner image has passed through the applying roller contact portion, a control signal is outputted to the driving section (not shown) for rotating the attaching/detaching member, to thereby perform an operation for moving the applying roller 78 away from the intermediate transfer belt 21. Note that the operation for moving the applying roller 78 away from the intermediate transfer belt 21 is preferably set so as to be performed after a lapse of predetermined period of time after the toner image has passed through the applying roller contact portion. In this case, a length of such a predetermined period of time can be selected as appropriate depending on a frequency of an image forming operation, and set by inputting a given number of minutes to an operating panel (not shown) provided on an upper surface of the image forming apparatus 91. Furthermore, the CPU 23 restarts an image forming operation, and moreover performs the operation of abutting the applying roller 78 on the intermediate transfer belt 21. With this configuration, the fixer fluid 50 is prevented from being excessively consumed and unnecessarily attached to the intermediate transfer belt 21.

For the contact detecting section 93, as in the case of the passage detecting section 92, there is used a light sensor, for example. A result detected by the contact detecting section 93 is inputted to the storing section of the CPU 23. In the determining section is determined a contact state between the intermediate transfer belt 21 and the applying roller 78. The contact states includes a state where the intermediate transfer belt 21 and the applying roller 78 are in contact with each other, a state where the intermediate transfer belt 21 and the applying roller 78 are away from each other, a state where the intermediate transfer belt 21 and the applying roller 78 are moving away from each other, and a state where the intermediate transfer belt 21 and the applying roller 78 are coming into contact with each other. The control section outputs, in accordance with a result that the intermediate transfer belt 21 and the applying roller 78 are in contact with each other or moving away from each other, a control signal to a driving section 94 serving as an applying member driving portion, for rotating the applying roller 78 so that a rotary operation of the applying roller 78 is effected.

The amount of the fixer fluid applied by the fixer fluid applying member 76 to the toner image on the intermediate transfer belt 21 can be selected as appropriate, for example, by adjusting the contact pressure (press force) of the applying roller 78 against the intermediate transfer belt 21 or by adjusting the contact pressure of the fixer fluid regulating roller 80 against the applying roller 78. The contact pressure is preferably selected from a range of 0.05 N/cm to 1.0 N/cm in terms of a linear pressure. When the contact pressure is less than 0.05 N/cm, the contact state between the applying roller 78 and the intermediate transfer belt 21 is unstable, so that the fixer fluid 50 cannot possibly be applied evenly to the toner image on the intermediate transfer belt 21. Further, the applying roller 78 cannot be elastically deformed in conformity with minute concavities and convexities in the applying roller 78 and intermediate transfer belt 21 or concavities and convexities in the toner image, and especially the fixer fluid 50 cannot be sufficiently applied to the concavities of the toner image, resulting in generation of unevenness in the application of the fixer fluid 50 and thus generation of fixing unevenness of the toner image, which may possibly lead troubles such as unevenness in glossiness or coloration. On the other hand, when the contact pressure exceeds 1.0 N/cm, the fixer fluid 50 on the surface of the applying roller 78 cannot pass through the applying roller contact portion in a state where the applying roller 78 and the intermediate transfer belt 21 rotate in pressure-contact with each other. As a result, there may be possibly caused troubles such as a counter flow of the fixer fluid 50 at the applying roller contact portion by which irregularities may be generated in the toner image. Note that, in the embodiment, the pressure-contact force between the applying roller 78 and the intermediate transfer belt 21 is set to be 0.5 N/cm at first.

Further, the surface of the applying roller 78 is formed of an elastic material and therefore elastically deformed in conformity with the concavities and convexities in the toner image. Accordingly, on a part where the toner image exists, the applying roller 78 abuts on the toner image via a thin layer of the fixer fluid 50. This makes it possible, even when the amount of toner is different from one part to another part, to apply the fixer fluid 50 evenly to both parts of the toner image where a large amount of toner exist and where a small amount of toner exist. Accordingly, it is possible to evenly fix a toner image even like a color image where largely different amount of the toner is attached from one part to another part, that is to say, it is possible to fix the toner image uniformly regardless of the amount of toner, so that an image of high quality can be obtained.

In the embodiment, a three-layered roller member is used as the applying roller 78, but there is no limitation imposed on the selection of the applying roller 78. For example, it is possible to use the applying roller 78 formed of a material exhibiting a high affinity (wettability) with the fixer fluid 50, preferably a material which exhibits a high affinity with the fixer fluid 50 with a lower elastic modulus than that of the toner 16. In this case, concerning the affinity with the fixer fluid 50, it is preferable that a contact angle with respect to the fixer fluid 50 be 50 degrees or more. Further, the elastic modulus indicates an elastic modulus in a radial direction of a roller formed of such a material. The elastic modulus is preferably one tenth of that of the toner, and more preferably one hundredth of that of the toner. Specific examples of such a material include rubber materials such as ethylene propylene rubber and urethane rubber; metal materials such as aluminum; and hydrophilic resin materials. In other words, for the applying roller 78, it is possible to preferably use a roller member having at least a surface layer formed of such a material. Since the roller member exhibits a high affinity with the fixer fluid 50 and is capable of retaining on a surface thereof the fixer fluid 50 in a formed of a thin layer, a small amount of the fixer fluid 50 can be applied to a large area so that a consumed amount of the fixer fluid 50 can be reduced, and moreover excess fixer fluid 50 pushes the unfixed toner 16 away so that the image is prevented from having irregularities generated therein. To be specific, there is used a roller member having a diameter of 20 mm, which is composed of: a shaft having a diameter of 12 mm; and an elastic coating layer provided on a surface of the shaft, having a Young modulus of 2 MPa formed of ethylene propylene rubber.

According to the result of surface temperature of the intermediate transfer belt 21 detected by the temperature sensor 31, the wet fixing section 7*c* applies the fixer fluid 50 to the toner image in contact with the fixing section 7*c*, the toner image which is formed on a predetermined position on the intermediate transfer belt 21 by means of the toner image forming section 2.

The toner image on the intermediate transfer belt 21 is made to pass through the a supporting roller contact portion, and subjected to heat and/or application of the fixer fluid 50 in a state where the toner image is in contact with the supporting roller contact portion, with the result that the toner image is brought into a fused state. Since the toner image in a fused state can be easily fixed on the recording material 9 under pressure or in other ways, the fused toner image on the intermediate transfer belt 21 is conveyed to a transferring nip portion that is a contact portion between the transfer roller 32 and the supporting roller 27 in the transferring section 4, where the fused toner image on the intermediate transfer belt 21 is transferred and simultaneously fixed on the recording material 9. The recording material 9 having the toner image fixed thereon is placed on the conveyance belt 33 in the recording material conveying section 5*a* and then conveyed by way of the discharge roller 41 to be discharged to the discharge tray 42 provided on an external side surface of the image forming apparatus 91.

In the embodiment, the transfer roller 32 is configured such that a voltage of +1 kV is applied to the transfer roller 32 so as to have a polarity opposite to a polarity of charged toner to thereby electrostatically attract the toner to conduct the transferring operation.

In the embodiment, for the transfer roller 32, there is used a roller member constituted by sequentially laminating, on an outer surface of a shaft having an outer diameter of 40 mm, a 2 mm-thick elastic layer made of silicone rubber which has been hardened to 50 degrees in terms of the hardness in JIS-A, and a 20 μm-thick surface coating layer made of PFA one after another. Further, the transfer roller 32 is brought into pressure-contact with the supporting roller 27 at a linear pressure of 10 N/cm.

In the image forming apparatus 91, the toner image formed on the intermediate transfer belt 21 through the toner forming section 2 is subjected to a heating process and/or an application process of the fixer fluid 50 at the supporting roller contact portion so that the toner image is brought into a fused state, and thereafter transferred and simultaneously fixed onto the recording material 9 in the transferring section 4 so that an image is formed.

Figure 9:
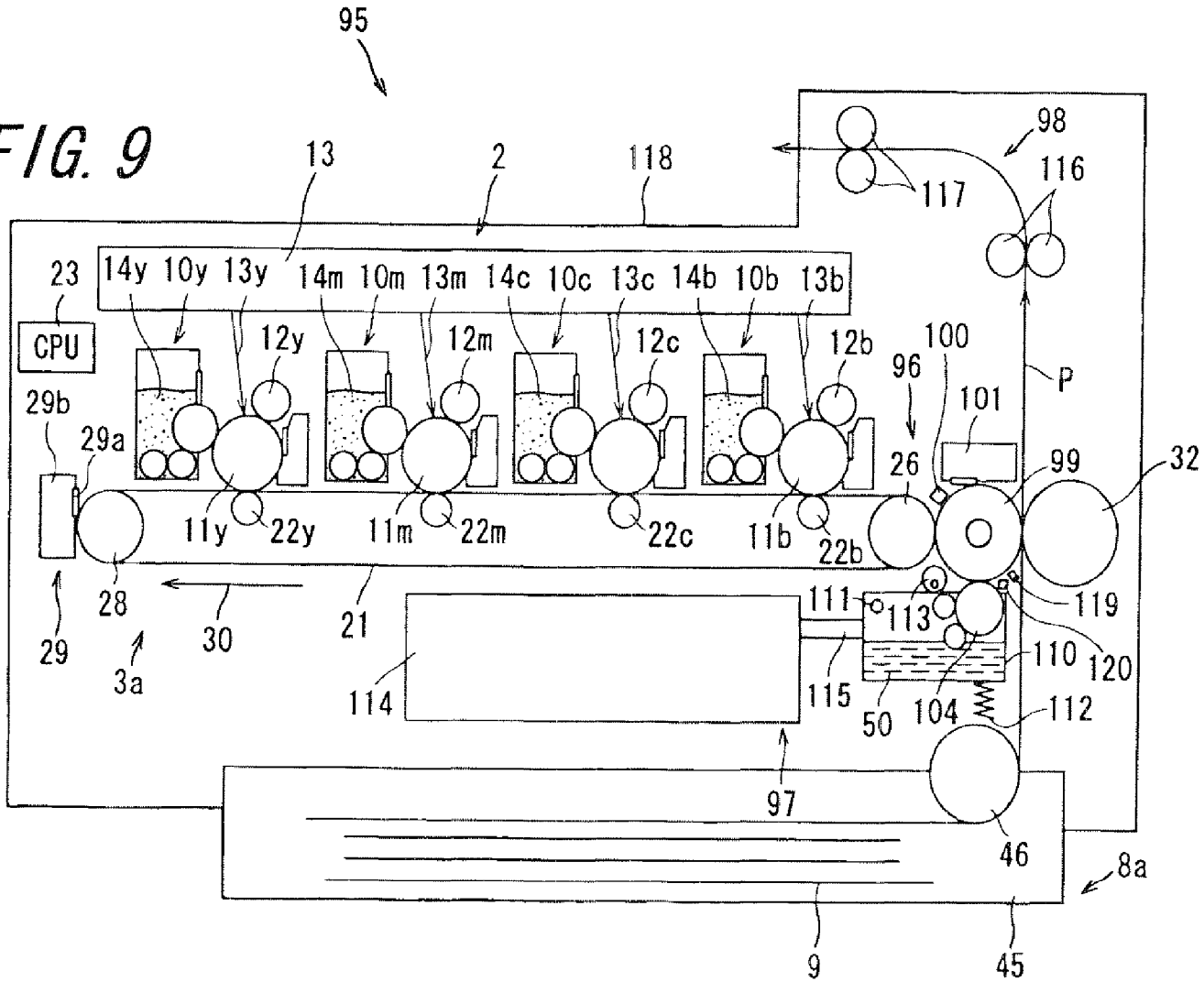
FIG. 9 is a sectional view schematically showing a constitution of an image forming apparatus according to a sixth embodiment.
Figure 10:
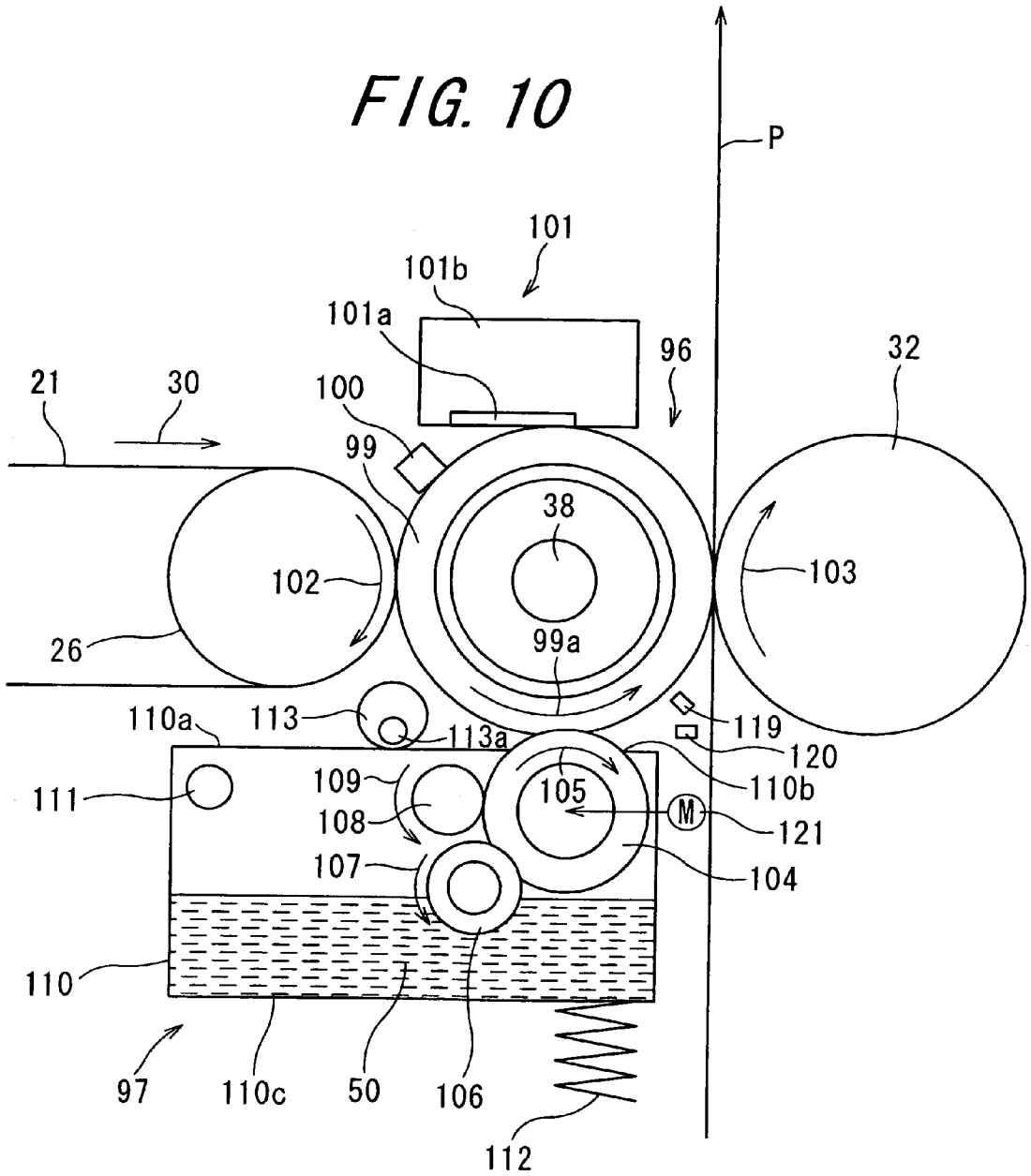
FIG. 10 is an enlarged sectional view showing a principal portion of the image forming apparatus depicted in FIG. 9.

FIG. 9 is a sectional view schematically showing a constitution of an image forming apparatus 95 according to a sixth embodiment. FIG. 10 is an enlarged sectional view showing a principal portion of the image forming apparatus 95 depicted in FIG. 9.

The image forming apparatus 95 includes the toner image forming section 2, an image carrying section 3*a*, a transfuse section 96, a wet fixing section 97, a recording material supply section 8*a*, and a recording material discharge section 98.

The image forming section 2 has a similar configuration to that of the image forming section 2 contained in the image forming apparatus 1. Therefore, the components that play the same or corresponding roles as in the image forming section 2 will be denoted by the same reference numerals, and descriptions thereof will be omitted.

The image carrying section 3*a* includes the intermediate transfer belt 21, the intermediate transfer rollers 22*y*, 22*m*, 22*c*, and 22*b*, the supporting rollers 26 and 28, and the belt cleaner 29. In the image carrying section 3*a*, on a downstream side from the intermediate transfer roller 22*b* along the rotating direction of the intermediate transfer belt 21 (the direction indicated by the arrow 30) is provided the supporting roller 26 having no heating section therein, but not provided other sections for heating the intermediate transfer belt 21. Accordingly, the image carrying section 3*a* is configured so as not to heat the intermediate transfer belt 21 and the toner image, and the temperature sensor for detecting the surface temperature of the intermediate transfer belt 21 may be provided or may not be provided. Further, the intermediate transfer belt 21 is supported at three points in the image forming apparatus 1, but such a configuration has been changed in the present embodiment where the intermediate transfer belt 21 is supported at two points; namely, the supporting rollers 26 and 28. Note that in the embodiment, there is used the intermediate transfer belt 21 constituted by laminating, on a surface of a 100 μm-thick polyimide-made base, a 20 μm-thick surface coating layer made of a fluororesin compound obtained by mixing PTFE and PFA at a ratio of 8:2 (by weight).

The transfuse section 96 includes a transfuse member 99, a transfer roller 32, a temperature sensor 100, and a cleaner 101. The transfuse member 99 is supported by a driving section (not shown) so as to be rotatable in a direction indicated by an arrow 99*a*, and brought into pressure-contact with the supporting roller 26 across the intermediate transfer belt 21. The transfer roller 32 is supported by a driving section (not shown) so as to be rotatable in a direction indicated by an arrow 103, that is a direction opposite to the direction indicated by the arrow 99*a*, and brought into pressure-contact with the transfuse member 99. The cleaner 101 is provided so as to abut on a surface of the transfuse member 99. Note that in the embodiment, the supporting roller 26 is supported by a driving section (not shown) so as to be rotatable in the direction indicated by the arrow 103, that is a direction opposite to the direction indicated by the arrow 99*a*.

The transfuse member 99 is a roller-like member having the heating section 38 disposed therein. For the transfuse member 99, there is used, for example, a roller-like member including: a shaft; an elastic layer formed on a surface of the shaft; and a surface layer formed on a surface of the elastic layer, containing materials excellent in toner releasing property such as fluororesin. In the embodiment, there is used a roller member having an outer diameter of 30 mm composed of: a 1 mm-thick shaft made of carbon steel; a 3 mm-thick silicone rubber layer having a volume resistance of $10^8$ to $10^9$ Ω·cm formed on a surface of the shaft; and a 20 μm-thick PFA layer formed on a surface of the silicone rubber layer. Further, for the heating section 38 disposed inside the transfuse member 99, there is used, for example, a commonly-used heater such as a halogen lamp. In the embodiment, the heating section 38 is used to conduct a control of keeping the surface temperature of the transfuse member 99 at 170° C. This control is performed in accordance with the result detected by the temperature sensor 100.

Onto the transfuse member 99 is transferred the toner image from the intermediate transfer belt 21. The transferring operation of the toner image is carried out by applying a transference electric field to a contact portion (transferring nip portion) between the transfuse member 99 and the intermediate transfer belt 21. The toner image on the surface of the transfuse member 99 is subjected to heat generated by the heating section 38 disposed inside the transfuse member 99, and/or subjected to application of the fixer fluid 50 through the wet fixing section 97. The toner image is thus brought into a fused or swelled state, and then conveyed to a contact portion (transferring nip portion) between the transfuse member 99 and the transfer roller 32, where the toner image is transferred and simultaneously fixed onto the recording material 9 fed from the recording material supply section 8 in synchronism with the conveyance of the toner image. In the embodiment, the transferring operation of the toner image from the intermediate transfer belt 21 to the transfuse member 99 is performed by applying a voltage of +1 kV from a power source (not shown) to the contact portion between the transfuse member 99 and the intermediate transfer belt 21 so as to give the contact portion a polarity opposite to a polarity of the charged toner 16. The toner image is electrostatically attracted to the transfuse member 99 to be thereby transferred thereon.

The temperature sensor 100 is a sensor disposed on an upstream side from the transferring nip portion along a rotating direction of the transfuse member 99; namely, the direction indicated by the arrow 99*a*, so as to be close to the transfuse member 99, for detecting the surface temperature of the transfuse member 9. The temperature sensor 100 includes a storing section, a calculating section, and a control section (none of which are shown). The temperature sensor 100 is electrically connected to the CPU 23 for controlling an entire operation of the image forming apparatus 95, and outputs a result of detected temperature to the storing section of the CPU 23. In the calculating section is determined which one of the detected temperature and the predetermined temperature is high or low, and in a case where the detected temperature is determined as being lower than the predetermined temperature, the control section outputs a control signal to a power source (not shown) for supplying the heating section 38 with electricity for generating heat, to thereby conduct a control of increasing the power supply so that a calorific power generated by the heating section 38 is increased. Further, according to the result detected by the temperature sensor 100, a subsequently-explained attaching/detaching movement of the wet fixing section 97 with respect to the transfuse member 99 is controlled. The control mechanism will be described in detail in an explanation of the wet fixing section 97.

The cleaner 101 is a member for removing undesired substances such as the toner 16 or fixer fluid 50 remaining on the surface of the transfuse member 99 and paper powder attributable to the recording material 9 after the toner image has been transferred onto the recording material 9. The cleaner 101 includes a cleaning blade 101*a* and a reservoir 101*b*. The cleaning blade 101*a* is a platy member which abuts on the surface of the transfuse member 99 to thereby scrape off the toner 16 and other residual substances thereon. The reservoir 101*b* accumulates the residual substances scrapped off by the cleaning blade 101*a*.

In the embodiment, for the transfer roller 32, there is used a roller member having an outer diameter of 40 mm constituted by forming on an outer surface of a shaft, a 2 mm-thick elastic layer made of silicone rubber which has been hardened to 50 degrees in terms of the hardness in JIS-A, and further forming on an outer surface of the elastic layer, a 20 μm-thick surface layer made of PFA. Further, in the embodiment, the transfer roller 32 is brought into pressure-contact with the transfuse member 99 at a press force of 10 N/cm. The fused or swelled toner image conveyed to the transfuse nip portion by rotation of the transfuse member 99 is pressurized by the transfer roller 32 to be thereby transferred and simultaneously fixed onto the recording material 9 so that an image is formed.

In the transfuse section 96, the toner image transferred from the intermediate transfer belt 21 to the surface of the transfuse member 99 is subjected to heat and/or application of the fixer fluid 50, with the result that the toner image is brought into a fused or swelled state and thereafter transferred and thus fixed onto the recording material 9 at the transfuse nip portion so that an image is formed. The surface of the transfuse member 99 after the toner image thereon is transferred and fixed on the recording material 9, is cleaned by the cleaner 101 to be subjected to transferring of a new toner image from the intermediate transfer belt 21.

The wet fixing section 97 comprises an applying roller 104, a fixer fluid supplying roller 106, a fixer fluid regulating roller 108, a fixer fluid reservoir 110, a pivot 111, an eccentric cam 113, a spring member 112, a fixer fluid tank 114, and a supply pipe 115. The applying roller 104 is detachably provided on the transfuse member 99. The fixer fluid supplying roller 106 abuts on the applying roller 104 and supplies the fixer fluid 50. The fixer fluid regulating roller 108 abuts on the applying roller 104 and regulates a fixer fluid layer (not shown) on a surface of the applying roller 104. The fixer fluid reservoir 110 houses the fixer fluid 50 as well as the applying roller 104, the fixer fluid supplying roller 106, and the fixer fluid regulating roller 108. The pivot 111, the eccentric cam 113, and the spring member 112 support the fixer fluid reservoir 110 and thus the applying roller 104 so as to be detachable with respect to the transfuse member 99. The fixer fluid tank 114 stores the fixer fluid 50. The supply pipe 115 supplies to the fixer fluid reservoir 110 the fixer fluid 50 contained in the fixer fluid tank 114. Furthermore, the wet fixing section 97 further comprises a passage detecting section 119, and a contact detecting section 120. The passage detecting section 119 detects that the toner image on the transfuse member 99 has passed through a contact portion (which will be hereinafter referred to simply as an applying roller contact portion) between the transfuse member 99 and the applying roller 104. The contact detecting section 120 detects a contact state between the transfuse member 99 and the applying roller 104.

The applying roller 104 is a roller-like member supported by the fixer fluid reservoir 110 so as to be rotatable in a direction indicated by an arrow 105, that is a direction opposite to the direction indicated by the arrow 99*a*. The applying roller 104 is provided so as to be detachable with respect to the transfuse member 99 by a subsequently-explained detaching/attaching section. Note that the applying roller 104 is supported by the fixer fluid reservoir 110 in such a manner that, to be specific, both ends in a longitudinal direction of a shaft part of the applying roller 104 are provided with rotary shafts integrally formed with flanges (not shown), and the rotary shafts are rotatably supported by bearings disposed on the fixer fluid reservoir 110. When the applying roller 104 is in contact with the transfuse member 99, the applying roller 104 supplies the fixer fluid 50 to the toner image on the surface of the transfuse member 99 while rotating in the direction indicated by the arrow 105. For the applying roller 104, it is possible to preferably use a roller-like member composed of a shaft and a surface layer formed on a surface of the shaft. The surface layer is formed of an elastic material which can be impregnated with the fixer fluid 50 to retain the fixer fluid 50 therein or which has wettability with respect to the fixer fluid 50. An elastic modulus in a radial direction of the surface layer is preferably one tenth of that of the toner 16, and more preferably one hundredth of that of the toner 16. The surface layer is formed of an elastic material so as to be deformed in conformity with the concavities and convexities in the toner image, with the result that the surface layer is brought to a state of abutting on the toner image via a thin layer of the fixer fluid 50. Accordingly, it is possible to evenly apply the fixer fluid 50 to an entire toner image on which the surface layer abuts by virtue of the elastic deformation of the surface layer, even when the toner image is a toner image, like a color image, where an attached amount of the toner is largely different from one part to another part, indicating that there exists a part having a small amount of the toner surrounded by a part having a large amount of the toner. As a result, it is possible to fix the toner image uniformly so that an image of high quality can be obtained. Further, an affinity (wettability) with respect to the fixer fluid 50, which is indicated as a contact angle with respect to the fixer fluid 50, is preferably 50 degrees or less so that an evenly-formed thin layer of the fixer fluid 50 can be held on the surface. Accordingly, a small amount of the fixer fluid 50 can be applied to a large area so that a consumed amount of the fixer fluid 50 can be reduced, and it is also possible to prevent the toner image from suffering irregularities caused by application of excess fixer fluid 50. Specific examples of the elastic material capable of forming such a surface layer include resin materials such as a hydrophilic resin material; rubber materials such as ethylene propylene rubber and urethane rubber; and metal materials such as aluminum. Further, it is also conceivable that the application of the fixer fluid 50 to the toner image causes a decrease in the temperature of the toner image. However, the transfuse member 99 has the heating section 38 therein to be therefore in a heated state at any time, with the result that the temperature decrease of the toner image is suppressed to a level where no adverse effect is made on the fixation of the toner image. In the embodiment, for the applying roller 104, there is used a roller-like member having a diameter of 20 mm composed of: a shaft having a diameter of 12 mm; and an elastic layer provided on a surface of the shaft, having a Young modulus of 2 MPa formed of ethylene propylene rubber.

Further, a press force of the applying roller 104 against the transfuse roller 99 in contact with each other is preferably 0.05 to 1.0 N/cm in terms of a linear pressure. When the press force is less than 0.05 N/cm, the contact state between the applying roller 104 and the transfuse member 99 is insufficient, so that the fixer fluid 50 cannot possibly be applied evenly to the toner image on the transfuse member 99. Further, the elastic deformation of the surface of the applying roller 104 in conformity with minute concavities and convexities in the transfuse member 99 and the surface of the toner image is insufficient so that a sufficient amount of the fixer fluid 50 cannot possibly be applied to the concavities of the toner image. As a result, there is generated unevenness in the application of the fixer fluid 50 and thus fixing unevenness of the toner image attributable to the unevenness in the application, and furthermore a to-be-formed image may possibly have troubles such as unevenness in glossiness or coloration. On the other hand, when the press force exceeds 1.0 N/m, the fixer fluid 50 cannot possibly pass through the contact portion between the applying roller 104 and the transfuse member 99 in a state where the applying roller 104 and the transfuse member 99 rotate in pressure-contact with each other. When the fixer fluid 50 does not pass through the contact portion, the fixer fluid 50 is compressed at an entrance of the contact portion where meniscus is therefore formed, and the fixer fluid 50 flows back to an upstream side in a rotation direction of the applying roller 104, with the result that irregularities of the toner image are generated. In the embodiment, the press force between the applying roller 104 and the transfuse member 99 is set to be 0.5 N/cm in terms of a liner pressure. Further, in the embodiment, the applying roller 104 carries on a surface thereof, at the time of being in contact with the transfuse member 99, the thin layer of the fixer fluid 50, and abuts on the transfuse member 99. In this case, the applying roller 104 rotates at the same velocity as that of the transfuse member 99 by means of a driving section 121 serving as an applying member driving section.

The fixer fluid supplying roller 106 is a roller-like member which is supported by the fixer fluid reservoir 110 so as to be rotatable in a direction indicated by an arrow 107, that is opposite to the direction indicated by the arrow 105, and bought into pressure-contact with the applying roller 104. The fixer fluid supplying roller 106 is provided so that a part thereof is dipped in the fixer fluid 50 contained in the lower part of the fixer fluid receiver 110. For the fixer fluid supplying roller 106, there is used, for example, a roller-like member composed of a shaft and a porous layer formed on a surface of the shaft. In the embodiment, there is used a sponge roller composed of a shaft having a diameter of 10 mm and a urethane resin-made continuous foam having a thickness of 5 mm formed on a surface of the shaft. The fixer fluid supplying roller 106 rotates in the direction indicated by the arrow 107 to thereby have the fixer fluid 50 attached to a surface thereof and then, the fixer fluid supplying roller 106 is brought into pressure-contact with the applying roller 104 to supply the fixer fluid 50 to the applying roller 104.

The fixer fluid regulating roller 108 is a roller-like member which is supported by the fixer fluid reservoir 110 so as to be rotatable in a direction indicated by an arrow 109, that is opposite to the direction indicated by the arrow 105, and bought into pressure-contact with the applying roller 104. For the fixer fluid regulating roller 108, there is used a metal-made hollow roller, for example. In the embodiment, there is used a stainless steel-made roller having an outer diameter of 12 mm. The fixer fluid regulating roller 108 adjusts an amount of the fixer fluid 50 on the surface of the applying roller 104 so that the thin layer having a uniform layer thickness of the fixer fluid 50 is formed.

The fixer fluid reservoir 110 is a container-like member having an internal space, which houses in the internal space the respective rollers of the applying roller 104, the fixer fluid supplying roller 106, and the fixer fluid regulating roller 108 in a state of being rotatably supported and which stores the fixer fluid 50 in a lower part of the internal space. In a surface 110*a* of the fixer fluid reservoir 110 facing the transfuse member 99 is formed an opening 110*b* through which a part of the applying roller 104 is made to protrude to outside of the fixer fluid reservoir 110 to abut on the transfuse member 99. To a side surface on a side that is opposite in a horizontal direction to an end where the roller-like member such as the applying roller 104 is provided, is connected a supply pipe 115 for supplying the fixer fluid 50 to the fixer fluid reservoir 110. Further, a level of the fixer fluid 50 stored in the lower part of the fixer fluid reservoir 110 is kept in a range, for example, that a part of the fixer fluid supplying roller 106 is constantly dipped in the fixer fluid 50 and the applying roller 104 is constantly not dipped in the fixer fluid 50. In accordance with the consumed amount of the fixer fluid 50, the fixer fluid 50 is replenished from the fixer fluid tank 114 containing the fixer fluid 50 by way of the supply pipe 115 to thereby keep the level of the fixer fluid 50 constant.

The pivot 111, the spring member 112, and the eccentric cam 113 serve as attaching/detaching sections for the applying roller 104 with respect to the transfuse member 99.

On the fixer fluid reservoir 110, the pivot 111 is provided at a position on an end on a side that is opposite in a horizontal direction to an end where the roller-like member such as the applying member 104 is provided, the end where the pivot 111 is never dipped in the fixer fluid 50. The pivot 111 is provided so as to penetrate the fixer fluid reservoir 110 in a longitudinal direction thereof, and has its axis supported by the main body of the image forming apparatus 95 so as to be rotatable. The spring member 112 has one end fixed on the main body of the image forming apparatus 95 and the other end connected to a bottom surface 110*c* in a vertical direction of the fixer fluid reservoir 110 on the same side where the roller-like member such as the applying roller 104 is provided, so as to press the bottom surface 110*c* of the fixer fluid reservoir 110. Usable examples of the spring member 112 include a coil spring, a leaf spring, and a torsion spring. The pivot 111 and the spring member 112 are provided at the above-described positions to thereby support the fixer fluid reservoir 110 so that an end in a horizontal direction thereof where the roller-like member such as the applying roller 104 is provided, can move up and down around the pivot 111 in a vertical direction of the fixer fluid reservoir 110. By adding an operation of the eccentric cam 113 further to operations of the pivot 111 and the spring member 112, the fixer fluid reservoir 110 is supported so that the applying roller 104 housed in the fixer fluid reservoir 110 can be attached to and detached from the transfuse member 99.

The eccentric cam 113 is supported by a driving section (not shown) so as to be rotatable around a rotary shaft 113*a*. The eccentric cam 113 is detachably provided in a region on the surface 110*a* of the fixer fluid reservoir 110 facing the transfuse member 99, between the end where the roller-like member such as the applying roller 104 is provided and the end where the pivot is provided. When the eccentric cam 113 comes into contact with the surface 110*a* of the fixer fluid reservoir 110 and then presses the surface 110*a*, the applying roller 104 is brought to a state of being away from the transfuse member 99. Further, even when the eccentric cam 113 is not in contact with the surface 110*a* or when the eccentric cam 113 is in contact with the surface 110*a* but not pressing the surface 110*a*, the applying roller 104 is brought into pressure-contact with the transfuse member 99.

For the passage detecting section 119, a light sensor is used, for example. In accordance with the result detected by the passage detecting section 119, the applying roller 104 is controlled to abut on the transfuse member 99 or to move away from the transfuse member 99. Such a control on the movement of the applying roller 104 is conducted by the CPU 23 which is electrically connected to the passage detecting section 119. The CPU 23 includes a storing section, a determining section, and a control section. The result detected by the passage detecting section 119 is inputted to the storing section which then stores the detected result. The determining section determines, on the basis of the result detected by the passage detecting section 119, whether the toner image on the transfuse member 99 has passed through the contact portion between the transfuse member 99 and the applying roller 104. The control section outputs, in accordance with a result determined by the determining section, a control signal to a driving section (not shown) for rotating the attaching/detaching member, and controls the attaching/detaching movement effected by the attaching/detaching member with respect to the transfuse member 99. For example, in a case where the determining section determines as a result that the toner image has passed through the applying roller contact portion, a control signal is outputted to the driving section (not shown) for rotating the attaching/detaching member, to thereby perform an operation for moving the applying roller 104 away from the transfuse member 99. Note that the operation for moving the applying roller 104 away from the transfuse member 99 is preferably set so as to be performed after a lapse of predetermined period of time after the toner image has passed through the applying roller contact portion. In this case, a length of such a predetermined period of time can be selected as appropriate depending on a frequency of an image forming operation, and set by inputting a given number of minutes to an operating panel (not shown) provided on an upper surface of the image forming apparatus 95. Furthermore, the CPU 23 restarts an image forming operation, and moreover performs the operation of abutting the applying roller 104 on the transfuse member 99. With this configuration, the fixer fluid 50 is prevented from being excessively consumed and unnecessarily attached to the transfuse member 99.

For the contact detecting section 120, as in the case of the passage detecting section 119, there is used a light sensor, for example. A result detected by the contact detecting section 120 is inputted to the storing section of the CPU 23. In the determining section is determined a contact state between the transfuse member 99 and the applying roller 104. The contact states includes a state where the transfuse member 99 and the applying roller 104 are in contact with each other, a state where the transfuse member 99 and the applying roller 104 are away from each other, a state where the transfuse member 99 and the applying roller 104 are moving away from each other, and a state where the transfuse member 99 and the applying roller 104 are coming into contact with each other. The control section outputs, in accordance with a result that the transfuse member 99 and the applying roller 104 are in contact with each other or moving away from each other, a control signal to a driving section (now shown) for rotating the applying roller 104 so that a rotary operation of the applying roller 104 is effected.

Rotation of the eccentric cam 113 is controlled in accordance with the result of surface temperature of the transfuse member 99 detected by the temperature sensor 100. In a state where the eccentric cam 113 presses the surface 110*a* so that the applying roller 104 has moved away from the transfuse member 99, the control in accordance with the result detected by the temperature sensor 100 is conducted specifically as follows.

The result detected by the temperature sensor 100 is sent to the CPU 23 composed of the storing section, the calculating section, and the control section (none of which are shown), for controlling the entire operation of the image forming apparatus 95. The CPU 23 includes a process circuit realized by a microcomputer or the like. The storing section includes a read-only memory (ROM), a random access memory (RAM), a hard disk drive (HDD), and the like. The transfuse member 99 is heated to 170° C. which is set as a target temperature. At the time of a start-up when the temperature of the transfuse member 99 is low, the result (the surface temperature of the transfuse member 99) detected by the temperature sensor 100 is inputted to the storing section, and in the calculating section, it is determined whether or not the detected result is a temperature (in the embodiment, 80° C.) appropriate for a contact application of the fixer fluid 50 to the toner image. In a case where it is determined that the detected result is a temperature lower than a heat-fixing temperature of the toner image, the toner is attached to the applying roller 104 and therefore, the applying roller 104 does not conduct the applying operation of the fixer fluid 50. After the temperature of the transfuse member 99 reaches 80° C., in accordance with the result determined by the calculating section, a control signal is sent from the control section to a driving section for effecting rotation of the eccentric cam 113 so that the eccentric cam 113 is made to rotate to release the surface 110*a* from the press imposed by the eccentric cam 113, and the applying roller 104 is made to abut on the transfuse member 99 to apply the fixer fluid 50 to the toner image on the transfuse member 99 so that the toner image is sufficiently fused or swelled to be fixed on the recording material 9. While the applying roller 104 applies the fixer fluid 50 to transfer/fix the toner image onto the recording medium 9, the heating operation of the transfuse member 99 continues to conduct a control for increasing the surface temperature of the transfuse member 99 at the same time.

In a condition that the temperature of the transfuse member 99 has not reached a predetermined temperature (for example, 170° C.) appropriate for the heat transfuse operation, the fixer fluid 50 is applied to the toner image on the heated transfuse member 99, and along with an assistance given by the heat action, the wet fixing operation is conducted. And in a case where the temperature of the transfuse member 99 has reached the predetermined temperature (for example, 170° C.) appropriate for the heat transfuse operation, the applying roller 104 is made to move away from the transfuse member 99 to stop the applying operation of the fixer fluid 50 onto the toner image on the transfuse member 99. In this case, the control section sends a control signal to a driving section (not shown) for the eccentric cam 113 to thereby conduct a control for moving the applying roller 104 away from the transfuse member 99.

Further, in a case where during the operation, the temperature of the transfuse member 99 is lower than the predetermined temperature (for example, 170° C.) appropriate for the heat transfuse operation, the applying roller 104 is made to abut again on the transfuse member 99, and the wet fixing operation and the heat fixing operation are combined to conduct the transfuse operation onto the recording medium 9. The temperature of the transfuse member 99 becomes lower than the heat fixing temperature of the toner image, for example, at the time of an image forming operation in which a large amount of work is continuously performed.

Also in this case, as a result of the following detecting operation conducted by the temperature sensor 100, there may be obtained a result such that the detected result is an appropriate temperature for the heat fixing operation or higher. In this case, the control section sends a control signal to a driving section (not shown) for the eccentric cam 113 to thereby conduct a control for moving the applying roller 104 away from the transfuse member 99.

As described above, it is possible to support the fixer fluid reservoir 110 by means of the pivot 111, the spring member 112, and the eccentric cam 113 so that the applying roller 104 accommodated in the fixer fluid reservoir 110 can be detached from and attached to the transfuse member 99 according to the result detected by the temperature sensor 100.

Further, as another example of control, in the storing section of the CPU 23 are stored, for example, the result of previously-detected temperature, the result of currently-detected temperature, the boiling point of the solvent contained in the fixer fluid 50, the softening point of the toner 16, the glass transition temperature of the toner 16, and the like factors. In the calculating section, the result of currently-detected temperature inputted to the storing section is compared with the result of previously-detected temperature, the boiling point of the solvent of the fixer fluid 50, the softening point and glass transition temperature of the toner 16, and the like factors to thereby determine which one of these two values is high or low. The control section conducts a control by outputting a control signal in accordance with a result determined by the calculating section.

The control section controls the applying roller 104 so as not to come into contact with the transfuse member 99 in accordance with the result that the detected temperature is lower than the glass transition temperature of the toner 16, for example. This applies, to be specific, a situation immediately after start-up or a situation during a recovering operation from a left state of the image forming apparatus 95, and the like situation. Further, in accordance with the detected result that the result of detected temperature is higher than the glass transition temperature of the toner 16, the control section controls the applying roller 104 so as to abut on the transfuse member 99.

To be specific, a temperature at which the applying roller 104 starts to apply the fixer fluid to the transfuse member 99, namely a fixer fluid application onset temperature is set to, for example, 65° C. Alternatively, the fixer fluid application onset temperature may be set at the same temperature as the surface temperature of the transfuse member 99, that is 75° C., so that at a fixer fluid nip portion where the fixer fluid 50 is applied to the toner image on the recording material 9, a temperature of the transfuse member 99 at a point where the transfuse member 99 and the recording material 9 start to contact with each other is higher than the softening point (70° C.) of wax contained in the toner 16.

In this configuration, the heating operation is carried out at the same time of application of the fixer fluid 50 immediately after the start of application of the fixer fluid 50. In this case, the wax contained in the toner 16 is softened by heat and at the same time, the fixer fluid 50 spreads out and permeates into the toner particles so that swelling and softening of the toner particles instantly occur in a vast area. As a result, there are increased mutually-binding force of the toner particles and adherability between the toner particles and the recording material 9. This makes it possible to further prevent the toner image from suffering irregularities due to the flow of the toner particles caused by application of the fixer fluid 50. Further, the fixer fluid 50 is heated on the transfuse member 99 and therefore, the toner image and the recording material 9 have less temperature decreases attributable to the application of the fixer fluid 50. As a result, the toner image is subjected to the heating operation, pressurizing operation, and application of the fixer fluid 50 at the fixer fluid nip portion so that the toner constituting the toner image is sufficiently softened, as a consequence whereof the toner image is fixed onto the recording material 9 with sufficiently high fixation strength. Furthermore, the fixer fluid 50 is applied to the toner image under heat and after the toner image has been softened, the excess fixer fluid 50 can be dried for a short period of time. It is therefore possible to further enhance the throughput which indicates a number of outputs per hour from the image forming apparatus 95. Moreover, a distance between a position where the fixer fluid 50 is applied to the toner image and a position where the toner image is transferred onto the recording material 9 can be set to be short, thus contributing to reduction in size of the image forming apparatus 95.

Concerning the application of the fixer fluid 50 with respect to the transfuse member 99 conducted by the applying roller 104, preferable is not such a control as being selected from only two options of "applying" or "not applying", but such a control as to change the application amount at a sequential or multistep process. For example, there can be cited such a control as changing the application amount according to the surface temperature of the transfuse member 99. To be more specific, the control is conducted in such a way that when the surface temperature is less than 120° C., a ratio of the toner to the fixer fluid is adjusted to be 1:2 (by weight, which will be the same hereinafter), and when the surface temperature is 120° C. or more and less than 140° C., the ratio is 1:1.5, and when the surface temperature is 140° C. or more and less than 160° C., the ratio is 1:1, and when the surface temperature is 160° C. or more and less than 170° C., the ratio is 1:0.5, and when the surface temperature exceeds 170° C., no fixer fluid is applied. The control on the application amount of the fixer fluid 50 is carried out, as in the case of the wet fixing sections 7*a*, 7*b*, by changing as appropriate, for example, a press force of the applying roller 104 with respect to the transfuse member 99 through a control on rotation of the eccentric cam 113, adjustment of a spring force of a press spring 112, etc.

On the other hand, the fixer fluid tank 114 is, for example, a container-like member formed of a material such as synthetic resin, which is inert to the fixer fluid 50. An internal space of the container-like member is stored the fixer fluid 50. The fixer fluid tank 114 can be realized in a form of a cartridge. At a point when the fixer fluid 50 contained in the fixer fluid tank 114 is all gone, this is detected by a sensor (not shown). The detected result is sent to the CPU 23 for controlling the entire operation of the image forming apparatus 95. In accordance with the detected result, the CPU 23 sends a control signal to an operating panel (not shown) provided on an upper surface in a vertical direction of the image forming apparatus 95 so that the operating panel shows that a time for replacing the fixer fluid tank 114 has come. Further, the fixer fluid tank 114 may be formed in such a way that only the fixer fluid 50 is replenished from outside.

The supply pipe 115 is a tube-like member formed of a flexible material, having one end thereof connected to the fixer fluid reservoir 110 and the other end thereof connected to the fixer fluid tank 114. Usable flexible materials include synthetic resin material, rubber material, metal material, and the like which have flexibility. The supply pipe 115 has a liquid supply section (not shown) connected thereto so that the fixer fluid reservoir 110 is replenished with the fixer fluid 50 from the fixer fluid tank 114 in accordance with a consumed level of the fixer fluid 50 in the fixer fluid reservoir 110.

In the wet fixing section 97, the applying roller 104 is detached from and attached to the transfuse member 99 in accordance with the result detected by the temperature sensor 100. For example, when the surface temperature of the transfuse member 99 is on a level at which only the heat fixing operation is not enough to fix the toner image sufficiently, the applying roller 104 is made to abut on the transfuse member 99, and the fixer fluid 50 is applied to the toner image on the transfuse member 99 so that the toner image is securely transferred and fixed onto the recording material 9.

The recording material supply section 8*a* includes the recording material cassette 45 for stocking the recording materials 9, and the pick-up roller 46 for directing the recording materials 9 to the conveyance path P one by one. The recording materials 9 stocked in the recording material cassette 45 are directed to the conveyance path P one by one through the pick-up roller 46, and furthermore directed to the transfuse nip portion in synchronism with the conveyance of the toner image toward the transfuse nip portion.

The recording material discharge section 98 includes a conveyance roller 116, a discharge roller 117, and a discharge tray 118 formed on an upper surface in a vertical direction of the image forming apparatus 95. In the recording material discharge section 98, the recording material 9 on which the toner image has been fixed by the transfuse section 96 is discharged to the discharge tray 118 by way of the conveyance roller 116 and the discharge roller 117.

In the image forming apparatus 95, the toner image is transferred and fixed onto the recording material 9 usually by the heat fixing operation, but in a case where the surface temperature of the transfuse member 99 is not on a level suitable for the heat fixing operation, there is conducted the wet fixing operation in which the fixer fluid 50 is applied to the toner image on the transfuse member 99. In accordance with the result of surface temperature of the transfuse member 99 detected by the temperature sensor 100, either one of the heat fixing operation and the wet fixing operation is selected to be performed. By so doing, even in a case where only the heat fixing operation is not enough to sufficiently fix the toner image, that is occasions such as a start-up time, a long standby time, and a time of an image forming operation in which a large amount of work is continuously performed, a warm-up time is not required so that the image forming operation can be smoothly carried out. Accordingly, in the image forming apparatus 95, the throughput which indicates a number of outputs per hour is prominently enhanced and furthermore, an operation for retaining heat of the transfuse member 99 is not required during the standby time, with the result that there can be attained an image forming apparatus whose consumed amount of energy as a whole apparatus is small.

In the embodiment, in a case where the fixer fluid 50 is applied to the unfixed toner image in contact with each other in the wet fixing operation, it is preferable that the temperature of the transfuse member 99 be higher than the glass transition temperature of the binder resin contained in the toner particles. In this state, the binder resin can be softened so that mutually-binding force between the toner particles is increased. As a result, it is possible to prevent troubles such as offset of the toner onto the transfuse member 99 and irregularities of the toner image. Consequently, it is possible to easily perform the contact application of the fixer fluid 50 onto the toner image on the transfuse member 99 by means of the applying roller 104.

Further, in the embodiment, the applying roller 104 is used to apply the fixer fluid 50 to the surface of the transfuse member 99, but a component for applying the fixer fluid 50 is not limited to the applying roller 104, and may be a nozzle head array, an ultrasonic sprayer, a spray nozzle using an air current, or the like member. In these noncontact applying methods of the fixer fluid, it is relatively easy to change the application amount of the fixer fluid according to the temperature.

Further, in the embodiment, there is employed a constitution such that the toner image is transferred from the intermediate transfer belt 21 onto the transfuse member 99 and then transferred and fixed onto the recording paper 9. However, it is also possible to employ a constitution such that the intermediate transfer belt 21 is heated and the toner image is transferred from the intermediate transfer belt 21 onto the recording paper 9 on which the toner image is fixed, as indicated in the previous embodiment.

In the image forming apparatus, the conditions to be fulfilled by the intermediate transfer belt, the conveyance belt, each of the rollers, etc., such as materials, layer structures, and dimensions are not limited to those as suggested in the above-described embodiments. For example, conventional roller elements that have commonly been used in the field of electrophotographic image forming technology may be used in their as-is state or with alterations.

Moreover, instead of a roller member, an endless member such as a belt may be adopted. Further, the belt components such as the intermediate transfer belt and the conveyance belt may be constructed in the form of a roller instead of the form of an endless belt.

Although the image forming apparatus is exemplified as a tandem-type color image forming apparatus, the technique of the technology is not limited thereto, but may be applied also e.g. to a so-called 4-rotation type color image forming apparatus in which an image of one given color is superimposedly produced at each time an intermediate transfer belt makes one turn. Moreover, the technique of the technology is not limited to a color image forming apparatus, but may be applied also to a monochromatic image forming apparatus.

For example, the image forming apparatus may be built as a copier, a printer, a facsimile, or a multi-function machine that combines two or more kinds of functions as mentioned just above.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. An image forming apparatus comprising:

a toner image forming section that forms a toner image composed of toner;

an image carrying section that carries an unfixed toner image;

a heating section that heats and fuses the unfixed toner image on the image carrying section;

a wet fixing section including an applying member that applies to the unfixed toner image on the image carrying section fixer fluid having an action of softening toner, and an attaching/detaching section that supports the applying member detachably with respect to the image carrying section; and a temperature detecting section that detects a temperature of the image carrying section.

2. The image forming apparatus of claim 1, wherein the wet fixing section further includes a fixer fluid storage section which stores the fixer fluid and supplies the fixer fluid to the applying member.

3. The image forming apparatus of claim 1, wherein the wet fixing section further includes a passage detecting section which detects that the unfixed toner image on the image carrying section has passed through a contact portion between the image carrying section and the applying member, wherein the attaching/detaching section moves the applying member away from the image carrying section according to a result detected by the passage detecting section that the unfixed toner image has passed through the contact portion.

4. The image forming apparatus of claim 1, wherein the wet fixing section further comprises:

an applying member driving section that rotates the applying member about a shaft center thereof; and a contact detecting section that detects a contact state between the applying member and the image carrying section, wherein the applying member driving section rotates the applying member according to a result detected by the contact detecting section, when the applying member comes into contact with the image carrying section, and or when the applying member moves away from the image carrying section.

5. The image forming apparatus of claim 1, wherein the wet fixing section further comprises:

a storing section that stores a result of temperature detected by the temperature detecting section, a boiling point of a solvent contained in the fixer fluid, a softening point of the toner, and a glass transition temperature of the toner; and a calculating section that compares a result of previously-detected temperature with a result of subsequently-detected temperature, both of which are stored in the storing section, to determine whether the detected temperature is increasing or decreasing, or comparing the detected temperature with at least one of the boiling point of the solvent contained in the fixer fluid, the softening point of the toner, and the glass transition temperature of the toner, to determine which is higher, wherein the applying member adjusts an amount of the fixer fluid applied to the unfixed toner image according to a result determined by the calculating section.

6. The image forming apparatus of claim 5, wherein the applying member decreases or increases the amount of the fixer fluid applied to the unfixed toner image according to a result obtained by the calculating section that the detected temperature is increasing or decreasing.

7. The image forming apparatus of claim 5, wherein the applying member stops to apply the fixer fluid to the unfixed toner image according to a result that the detected temperature is higher than the boiling point of the solvent contained in the fixer fluid.

8. The image forming apparatus of claim 5, wherein the applying member starts to apply the fixer fluid to the unfixed toner image according to a result that the detected temperature is higher than the glass transition temperature of the toner.

9. The image forming apparatus of claim 5, wherein the applying member applies the fixer fluid to the unfixed toner image according to a result that the detected temperature is higher than a temperature intermediate between the glass transition temperature of the toner and the softening point of the toner.

10. An image forming apparatus comprising:

a toner image forming section that forms a toner image composed of toner;

an image carrying section that carries an unfixed toner image;

a transfuse section including a transfuse member that transfers and fixes the unfixed toner image on the image carrying section onto a recording material;

a heating section that heats and fuses the unfixed toner image on the transfuse member;

a wet fixing section including an applying member that applies to the unfixed toner image on the transfuse member fixer fluid having an action of softening toner, and an attaching/detaching section that supports the applying member detachably with respect to the transfuse member; and a temperature detecting section that detects a temperature of the transfuse member.

11. The image forming apparatus of claim 10, wherein the wet fixing section further includes a fixer fluid storage section which stores the fixer fluid and supplies the fixer fluid to the applying member.

12. The image forming apparatus of claim 10, wherein the wet fixing section further includes a passage detecting section which detects that the unfixed toner image on the transfuse member has passed through a contact portion between the transfuse member and the applying member, wherein the attaching/detaching section moves the applying member away from the transfuse member according to a result detected by the passage detecting section that the unfixed toner image has passed through the contact portion.

13. The image forming apparatus of claim 10, wherein the wet fixing section further comprises:

an applying member driving section that rotates the applying member about a shaft center thereof; and a contact detecting section that detects a contact state between the applying member and the transfuse member, wherein the applying member driving section rotates the applying member according to a result detected by the contact detecting section, when the applying member comes into contact with the transfuse member, or when the applying member moves away from the transfuse member.

14. The image forming apparatus of claim 10, wherein the wet fixing section further comprises:

a storing section that stores a result of temperature detected by the temperature detecting section, a boiling point of a solvent contained in the fixer fluid, a softening point of the toner, and a glass transition temperature of the toner; and a calculating section that compares a result of previously-detected temperature with one of subsequently-detected temperature, both of which are stored in the storing section, to determine whether the detected temperature is increasing or decreasing, or comparing the detected temperature with at least one of the boiling point of the solvent contained in the fixer fluid, the softening point of the toner, and the glass transition temperature of the toner, to determine which is higher, wherein the applying member adjusts an amount of the fixer fluid applied to the unfixed toner image according to a result determined by the calculating section.

15. The image forming apparatus of claim 14, wherein the applying member decreases or increases the amount of the fixer fluid applied to the unfixed toner image according to a result obtained by the calculating section that the detected temperature is increasing or decreasing.

16. The image forming apparatus of claim 14, wherein the applying member stops to apply the fixer fluid to the unfixed toner image according to a result that the detected temperature is higher than the boiling point of the solvent contained in the fixer fluid.

17. The image forming apparatus of claim 14, wherein the applying member starts to apply the fixer fluid to the unfixed toner image according to a result that the detected temperature is higher than the glass transition temperature of the toner.

18. The image forming apparatus of claim 14, wherein the applying member applies the fixer fluid to the unfixed toner image according to a result that the detected temperature is higher than a temperature intermediate between the glass transition temperature of the toner and the softening point of the toner.

19. An image forming apparatus comprising:

a toner image forming section that forms a toner image composed of toner;

an image carrying section that carries an unfixed toner image;

a transferring section that transfers the unfixed toner image on the image carrying section onto a recording material;

a heat fixing section including a heating section that heats and fuses the unfixed toner image, and a fixing member that fixes onto the recording material the unfixed toner image being heated and fused;

a temperature detecting section that detects a temperature of the fixing member;

a wet fixing section that applies to the unfixed toner image fixer fluid having an action of softening the toner, wherein the wet fixing section applies the fixer fluid to the unfixed toner image by way of the fixing member, and wherein the wet fixing section comprises:

an applying member which applies the fixer fluid, wherein the applying member adjusts an application amount of the fixer fluid according to the result of temperature detected by the temperature detecting section, and a fixer fluid storage section which stores the fixer fluid and supplies the fixer fluid to the applying member.

20. An image forming apparatus comprising:

a toner image forming section that forms a toner image composed of toner, an image carrying section that carries an unfixed toner image;

a transferring section that transfers the unfixed toner image on the image carrying section onto a recording material;

a heat fixing section including a heating section that heats and fuses the unfixed toner image, and a fixing member that fixes onto the recording material the unfixed toner image being heated and fused;

a temperature detecting section that detects a temperature of the fixing member;

a wet fixing section that applies to the unfixed toner image fixer fluid having an action of softening the toner, wherein the wet fixing section applies the fixer fluid to the unfixed toner image by way of the fixing member, and wherein the wet fixing section comprises:

an applying member which applies the fixer fluid a fixer fluid storage section which stores the fixer fluid and supplies the fixer fluid to the applying member, and an attaching/detaching section which supports the applying member detachably with respect to the image carrying section or the fixing member, the attaching/detaching section bringing the applying member into contact with the image carrying section or the fixing member according to the result of temperature detected by the temperature detecting section, and wherein the applying member applies the fixer fluid in a state of being in contact with the image carrying section or the fixing member.

21. An image forming apparatus, comprising:

a toner image forming section that forms a toner image composed of toner;

an image carrying section that carries an unfixed toner image;

a transferring section that transfers the unfixed toner image on the image carrying section onto a recording material;

a heat fixing section including a heating section that heats and fuses the unfixed toner image, and a fixing member that fixes onto the recording material the unfixed toner image being heated and fused;

a wet fixing section that applies to the unfixed toner image fixer fluid having an action of softening the toner;

a temperature detecting section that detects a temperature of the fixing member; and a recording material conveying section which conveys the recording material for carrying the unfixed toner image to either the heat fixing section or the wet fixing section based on the temperature of the fixing member.

22. The image forming apparatus of claim 21, wherein the recording material conveying section comprises a conveyance switching section which switches a conveyance destination of the recording material for carrying the unfixed toner image based on the temperature detected by the temperature detecting section.

23. An image forming apparatus, comprising:

a toner image forming section that forms a toner image composed of toner;

an image carrying section that carries an unfixed toner image;

a transferring section that transfers the unfixed toner image on the image carrying section onto a recording material;

a heat fixing section including a heating section that heats and fuses the unfixed toner image, and a fixing member that fixes onto the recording material the unfixed toner image being heated and fused;

a wet fixing section that applies to the unfixed toner image fixer fluid having an action of softening the toner;

a temperature detecting section that detects a temperature of the fixing member; and a recording material conveying section which conveys the recording material for carrying the unfixed toner image to the heat fixing section by way of the wet fixing section, and wherein an amount of fixer fluid applied to the unfixed toner image is adjusted based on the temperature of the fixing member.

24. An image forming apparatus, comprising:

a toner image forming section that forms a toner image composed of toner;

an image carrying section that carries an unfixed toner image;

a transferring section that transfers the unfixed toner image on the image carrying section onto a recording material;

a heat fixing section including a heating section that heats and fuses the unfixed toner image, and a fixing member that fixes onto the recording material the unfixed toner image being heated and fused;

a wet fixing section that applies to the unfixed toner image fixer fluid having an action of softening the toner, wherein the wet fixing section comprises a fixer fluid atomization section disposed away from the image carrying section or the fixing member, wherein the fixer fluid atomization section forms the fixer fluid into droplets having a diameter equal to or less than twice an average particle diameter of toner, and wherein the fluid atomization section sprays the droplets onto the image carrying section or the fixing member.

25. An image forming apparatus, comprising:

a toner image forming section that forms a toner image composed of toner;

an image carrying section that carries an unfixed toner image;

a transferring section that transfers the unfixed toner image on the image carrying section onto a recording material;

a heat fixing section including a heating section that heats and fuses the unfixed toner image, and a fixing member that fixes onto the recording material the unfixed toner image being heated and fused;

a temperature detecting section that detects a temperature of the fixing member; and a wet fixing section that applies to the unfixed toner image fixer fluid having an action of softening the toner, wherein an amount of fixer fluid applied to the unfixed toner image is adjusted based on the temperature of the fixing member.

* * * * *